US008369736B2

(12) United States Patent
Takashima et al.

(10) Patent No.: US 8,369,736 B2
(45) Date of Patent: Feb. 5, 2013

(54) DEVELOPING DEVICE AND IMAGE FORMING APPARATUS

(75) Inventors: Yoshiyuki Takashima, Kanagawa (JP); Hideki Kuge, Kanagawa (JP); Takuji Matsumoto, Saitama (JP); Taiyou Uehara, Kanagawa (JP); Shingo Natsume, Kanagawa (JP); Youichi Seki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 273 days.

(21) Appl. No.: 12/791,374

(22) Filed: Jun. 1, 2010

(65) Prior Publication Data

US 2011/0123229 A1 May 26, 2011

(30) Foreign Application Priority Data

Nov. 20, 2009 (JP) ..... 2009-265522

(51) Int. Cl.
*G03G 15/08* (2006.01)

(52) U.S. Cl. ..... 399/102; 399/103

(58) Field of Classification Search ..... 399/98, 399/102, 103
See application file for complete search history.

(56) References Cited

U.S. PATENT DOCUMENTS

| | | | | |
|---|---|---|---|---|
| 5,383,009 | A * | 1/1995 | Tsusaka | 399/111 |
| 6,295,429 | B1 * | 9/2001 | Isobe et al. | 399/227 |
| 2005/0111876 | A1 * | 5/2005 | Ahn et al. | 399/103 |
| 2007/0280725 | A1 * | 12/2007 | Hosokawa et al. | 399/103 |
| 2008/0232858 | A1 | 9/2008 | Uematsu | |

FOREIGN PATENT DOCUMENTS

JP A 2008-268881 11/2008

* cited by examiner

*Primary Examiner* — Walter L Lindsay, Jr.
*Assistant Examiner* — Roy Y Yi
(74) *Attorney, Agent, or Firm* — Oliff & Berridge, PLC

(57) ABSTRACT

A developing device includes: a developer holding member that faces an image carrier on which a latent image is formed and rotating while holding developer; a developing housing with a holding member mount that mounts developer holding member, and accommodates developer; a developer container connected to the developing housing and containing developer that flows into the developing housing; a partition member disposed in the developer container and partitioning an inner space of the developer container; and a loosening member having a loosening portion disposed in the developer container and extending along one side surface and another side surface of the partition member to partition the developer container, and a drawing portion that is connected to the loosening portion and extends from a port formed in the developer container to the outside of the developer container. When the drawing portion is drawn out, the loosening portion moves to loosen the developer.

19 Claims, 31 Drawing Sheets

Gy(Gm,Gc,Gk)
RC
RC1
67
66
53
54
51
52
32
34
33
36
72
36b
36a
FC
68
69
70
71
Z
(-X)
Y
(-Z)
X
(-Y)

Z
(-X)
Y
(-Z)
X
(-Y)
RC
RC1
51
53
66
34b
54
73
77
92
32
34
33
36
G8
G6
88
93
87
71
78
79
34a
G7

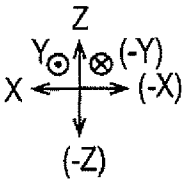
FIG.29A
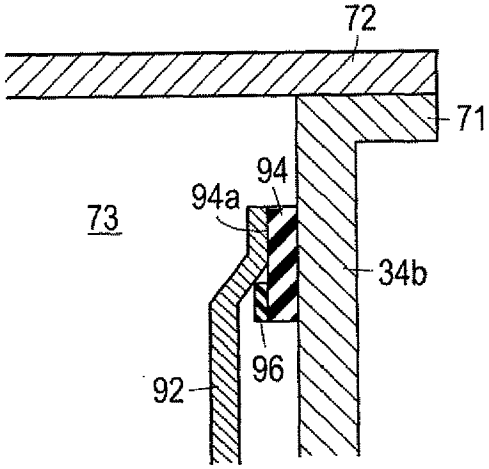
FIG.29B
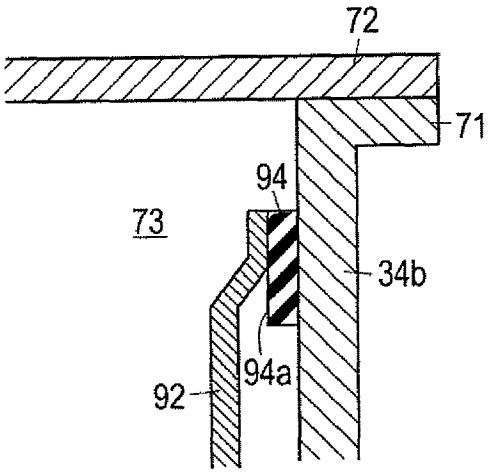
FIG.29C
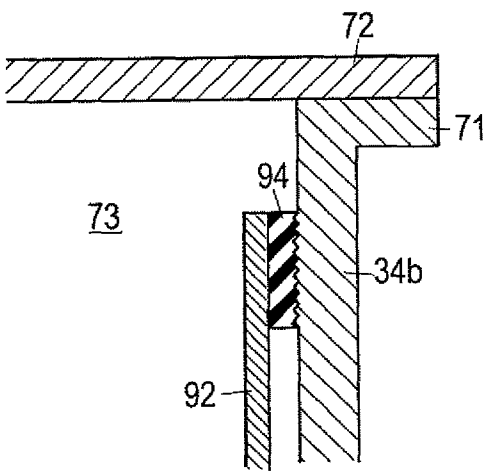
FIG.29D
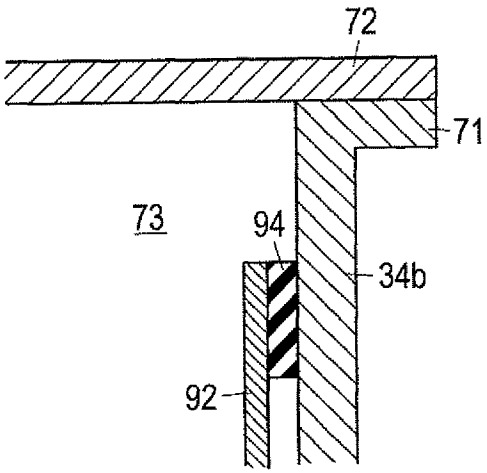
FIG.29E
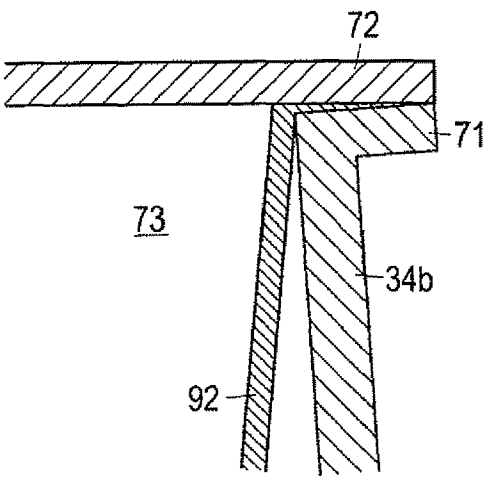

DEVELOPING DEVICE AND IMAGE FORMING APPARATUS

CROSS-REFERENCE TO RELATED APPLICATION

This application is based on and claims priority under 35 USC 119 from Japanese Patent Application No. 2009-265522 filed Nov. 20, 2009.

BACKGROUND

Technical Field

The present invention relates to a developing device and an image forming apparatus.

SUMMARY

According to an aspect of the present invention, there is provided a developing device including: a developer holding member being disposed so as to face an image carrier having a surface on which a latent image is formed and rotating while holding developer on the surface thereof; a developing housing that has a holding member mount unit in which the developer holding member is mounted, and accommodates developer therein; a developer container that is connected to the developing housing through an inlet port and contains developer that flows into the developing housing; a partition member that is disposed in the developer container and partitions an inner space of the developer container; and a loosening member having a loosening portion that is disposed in the developer container so as to extend along one side surface and the other side surface of the partition member for partitioning the inner space of the developer container, and a drawing portion that is connected to the loosening portion and extends from a loosening drawing port formed in the developer container to the outside of the developer container, wherein, when the drawing portion is drawn out, the loosening portion moves to loosen the developer in the developer container.

BRIEF DESCRIPTION OF THE DRAWINGS

Exemplary embodiments of the present invention will be described in detail based on the following figures, wherein:

FIGS. 10A and 10B are diagrams when the process unit of FIG. 9 is viewed from a direction of an arrow X of FIG. 9, wherein FIG. 10A is a diagram showing the overall process unit, and FIG. 10B is an enlarged diagram of a main part of a rear end portion;

FIGS. 11A and 11B are perspective views of a developing unit when the developing unit is viewed obliquely from the upper right front side, wherein FIG. 11A is a perspective view of the overall developing unit, and FIG. 11B is an enlarged view of a front end potion of the developing unit;

FIGS. 14A to 14C are diagrams showing a main part of a developing unit main body, wherein FIG. 14A is a perspective view of the developing unit main body under a state that a developing roll and an initial developer container are detached, FIG. 14B is a perspective view showing a supply auger and FIG. 14C is a perspective view showing an admix auger;

FIGS. 15A and 15B are enlarged views of a main part of a connection terminal, wherein FIG. 15A is a diagram showing the main part under a state that the connection terminal is not connected to the connection target terminal potion at the main body side, and FIG. 15B is a diagram showing the main part under a state that the connection terminal is connected to the connection target terminal at the main body side;

FIGS. 18A to 18C are diagrams showing the protection member according to the exemplary embodiment, wherein FIG. 18A is a perspective view of the protection member when viewed obliquely from the lower side, FIG. 18B is a perspective view showing the protection member when viewed obliquely from the upper side, and FIG. 18C is a perspective view showing a protection connection terminal;

FIGS. 19A to 19C are diagrams showing the relationship of an identification target potion to be identified and a regulation target potion to be regulated in the process unit and an identifying unit and a regulating unit in the unit mounting portion according to the exemplary embodiment, wherein FIG. 19A is a diagram showing a state under which the engagement between the regulation target portion and the regulating unit is started, FIG. 19B is a diagram showing a state that the engagement between the identification target portion and the identifying unit is started under the state that the process unit is inserted from the state shown in FIG. 19A and the regulation target portion and the regulating unit are engaged with each other, and FIG. 19C is a diagram showing a state that the mounting of the process unit is completed, so that the identifying unit and the identification target portion are engaged with each other and the engagement between the regulation target portion and the regulating unit is released;

FIGS. 26A to 26C are diagrams showing the front end portion of the developer container, wherein FIG. 26A is a diagram showing the overall front end portion, FIG. 26B is an enlarged view showing a main part of the front end portion, and FIG. 26C is a diagram showing a state that a contact member is detached;

FIGS. 27A and 27B are diagrams showing the contact member, wherein FIG. 27A is an exploded view of the contact member, and FIG. 27B is a cross-sectional view showing a main part of the contact member;

FIGS. 28A to 28C are diagrams showing a sealing member according to the exemplary embodiment, wherein FIG. 28A is a diagram showing a state before the sealing member is detached, FIG. 28B is a diagram showing a state that the sealing member is being detached, and FIG. 28C is a diagram showing a state that the sealing member is detached;

FIGS. 29A to 29E are diagrams showing a method of fixing the loosening member and the developer container, wherein FIG. 29A is a diagram showing the fixing method according to the exemplary embodiment, FIG. 29B is a diagram showing a fixing method according to a first modification of the exemplary embodiment, FIG. 29C is a diagram showing a fixing method according to a second modification of the exemplary embodiment, FIG. 29D is a diagram showing a fixing method according to a third modification of the exemplary embodiment, and FIG. 29E is a diagram showing a fixing method according to a fourth modification of the exemplary embodiment;

FIGS. 30A to 30C are diagrams showing a process that the loosening member of the exemplary embodiment is drawn out, wherein FIG. 30A is a diagram showing a state that the loosening member is drawn out to the front side from the state shown in FIG. 24, FIG. 30B is a diagram showing a state that the loosening member is further drawn out to the front side from the state shown in FIG. 30A, and FIG. 30C is a diagram showing a state that the loosening member is further drawn out to the front side from the state shown in FIG. 30B; and FIGS. 31A and 31B are diagrams showing the relationship between the identification target portion and the regulation target portion of the process unit and the identifying unit and the regulating unit of the unit mount unit, wherein FIG. 31A is a diagram showing the configuration of the exemplary embodiment, and FIG. 31B is a diagram showing a state that the regulation target portion and the regulating unit are arranged at the opposite side to the exemplary embodiment.

DETAILED DESCRIPTION

Exemplary embodiments according to the present invention will be described with reference to the accompanying drawings, however, the present invention is not limited to the following exemplary embodiments.

In order to make the following description easily understandable, in the figures, a front-and-rear direction is defined as an X-axis direction, a right-and-left direction is defined as a Y-axis direction, an up-and-down direction is defined as a Z-axis direction, directions or sides represented by arrows X, −X, Y, −Y, Z and −Z are defined as forward, rearward, rightward, leftward, upward and downward, or front side, rear side, right side, left side, upper side and lower side, respectively.

Furthermore, in the figures, a symbol "dot (•) in circle (○)" represents an arrow directing from the back side of the paper surface to the front side of the paper surface, and a symbol "x in circle (○)" represents an arrow directing from the front side of the paper surface to the back side of the paper surface.

In the following description which will be made with reference to the drawings, members other than members required for the description are omitted from the illustrations to make the understanding easy.

Exemplary Embodiment

Figure 1:
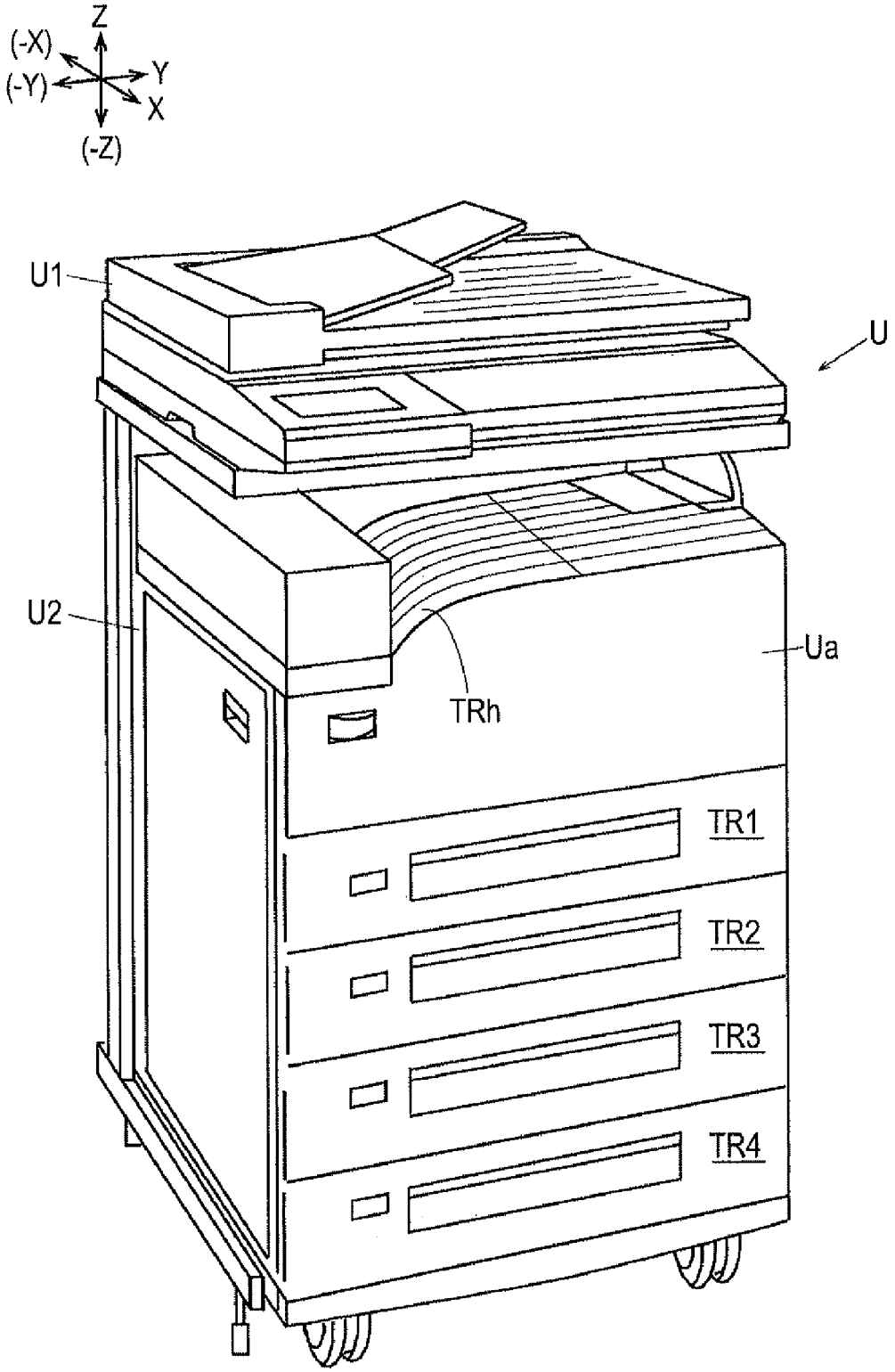
FIG. 1 is a perspective view showing an image forming apparatus according to an exemplary embodiment of the present invention.
Figure 2:
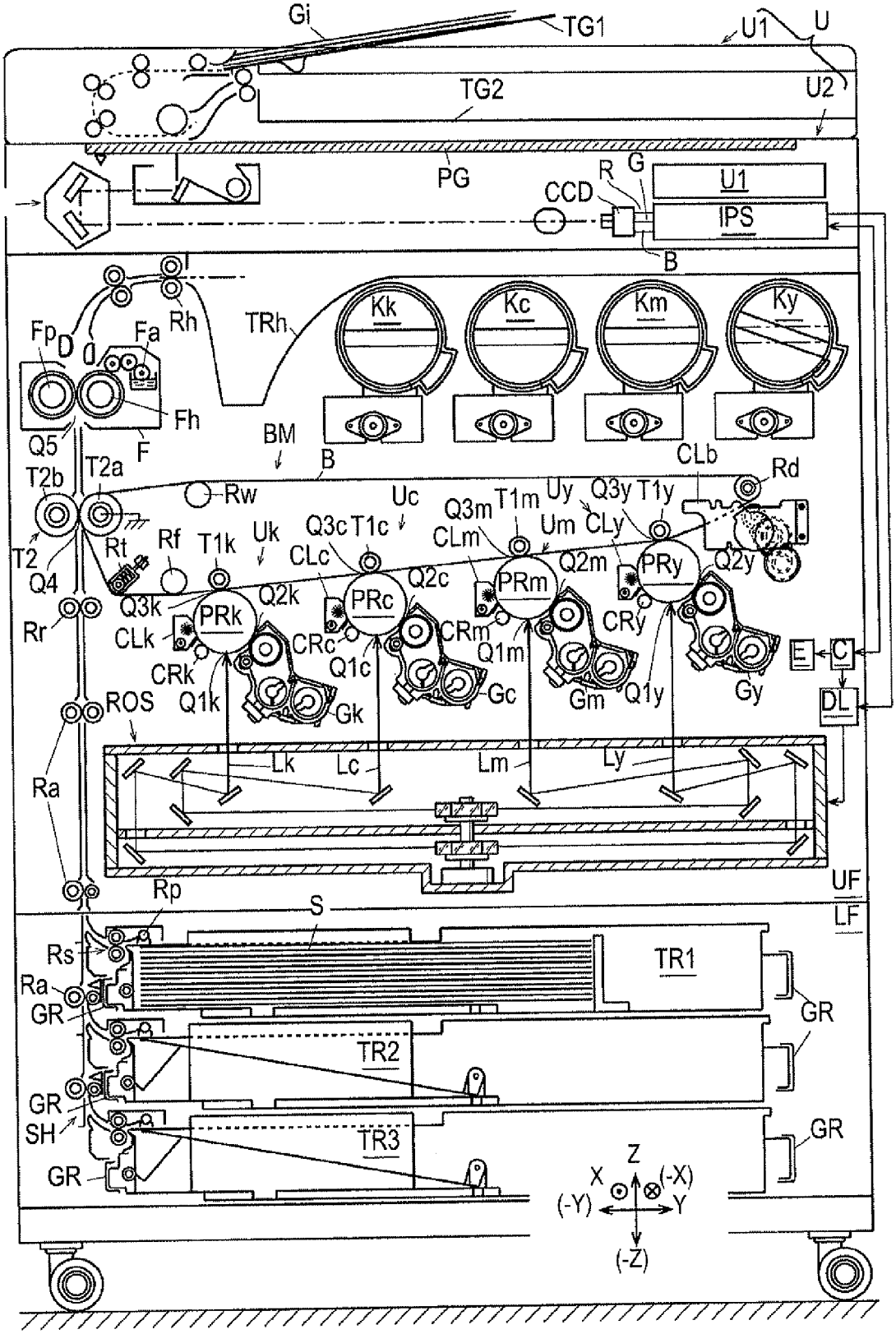
FIG. 2 is a diagram showing the overall configuration of the image forming apparatus according to the exemplary embodiment.

FIG. 1 is a perspective view showing an image forming apparatus according to an exemplary embodiment of the present invention, and FIG. 2 is a diagram showing the overall configuration of the image forming apparatus according to the exemplary embodiment of the present invention.

In FIGS. 1 and 2, a copying machine U as an example of the image forming apparatus has an automatic document feeder U1, and an image forming apparatus main body U2 which supports the automatic document feeder U1 and has a transparent document reading face PG at the upper end thereof.

In FIG. 1, a front cover Ua as an example of an opening/closing member which is opened/closed when a part or the like is exchanged is mounted on the front face of the image forming apparatus main body U2 so as to be openable/closable.

In FIG. 2, the automatic document feeder U1 has a document feeding unit TG1 and a document discharge unit TG2. Plural documents G1 to be copied are stacked and accommodated in the document feeding unit TG1, and a document G1 which is fed from the document feeding unit TG1 and passed over a document reading position on a document reading face PG is discharged to the document discharge unit TG2. The image forming apparatus main body U2 has an operating unit UI with which a user inputs an operation instructing signal to start an image forming operation or the like, an exposure optical system A, etc.

Reflection light from a document which is fed onto the document reading face PG in the automatic document feeder U1 or a document which is manually placed on the document reading face PG is converted to red (R), green (G) and blue (B) electrical signals through the exposure optical system A by a solid-state image pickup device CCD.

An image processor IPS converts the RGB electrical signals input from the solid-state image pickup device CCD to image information of black (K), yellow (Y), magenta (M) and cyan (C), temporarily stores the image information and outputs the image information as image information for forming a latent image to a latent image forming circuit DL at a preset timing.

When a document image is a so-called monochromatic image, image information of only black (K) is input to the latent image forming circuit DL.

The latent image forming circuit DL has driving circuits for respective colors Y, M, C and K (not shown), and outputs a signal corresponding to input image information to a latent image forming device ROS at a preset timing.

Figure 3:
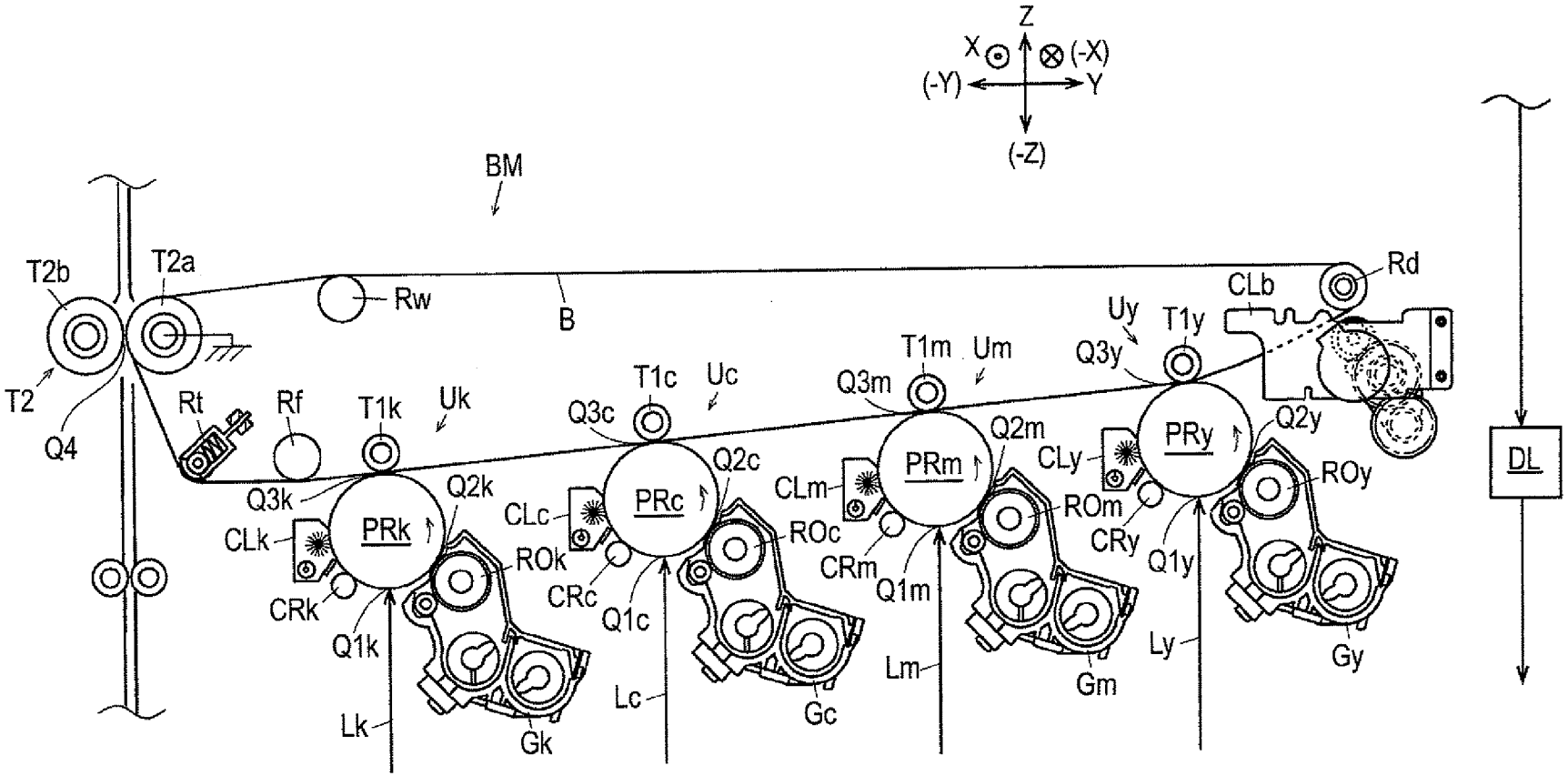
FIG. 3 is an enlarged view of a main part of the image forming apparatus according to the exemplary embodiment.

FIG. 3 is an enlarged view of a main part of the image forming apparatus according to the exemplary embodiment.

Visible image forming devices Uy, Um, Uc, Uk for forming visible images of respective colors of Y, M, C and K are disposed above the latent image forming device ROS.

The visible image forming device Uy of Y has a rotating photoconductor PRy as an example of an image carrier, a charger CRy, a developing device Gy and a photoconductor cleaner CLy as an example of an image carrier cleaning unit. In this exemplary embodiment, the visible image forming device Uy is configured as a process unit as an example of a detachable unit which is integrally detachably mounted in the image forming apparatus main body U2.

The visible image forming devices Um, Uc and Uk are configured to have the same configuration as the visible image forming device Uy of Y.

In FIGS. 2 and 3, the photoconductors PRy, PRm, PRc, PRk are respectively charged by the chargers CRy, CRm, CRC, CRk, and then electrostatic latent images are formed on the surfaces of the photoconductors PRy, PRm, PRc, PRk at image writing positions Q1*y*, Q1*m*, Q1*c*, Q1*k* by respective latent image writing light beams Ly, Lm, Lc, Lk of Y, M, C, K emitted from the latent image forming device ROS. The electrostatic latent images on the surfaces of the photoconductors PRy, PRm, PRc, PRk are developed into toner images of respective colors as examples of visible images in developing areas Q2*y*, Q2*m*, Q2*c*, Q2*k* by developer (developing agents) held in developing rolls R0*y*, R0*m*, R0*c*, R0*k* as examples of developer holders of the developing devices Gy, Gm, Gc, Gk.

The respective developed toner images are carried to primary transfer areas Q3Y, Q3*m*, Q3*c*, Q3*k* which are brought into contact with an intermediate transfer belt B as an example of an intermediate transfer member. A primary transfer voltage having the opposite polarity to the charge polarity of the toner is applied at a preset timing from a power supply circuit E controlled by a controller C to primary transfer units T1*y*, T1*m*, T1*c*, T1*k* which are arranged at the back surface side of the intermediate transfer belts B in the primary transfer areas Q3*y*, Q3*m*, Q3*c*, Q3*k*.

The respective toner images on the photoconductors PRy to PRk are primarily transferred onto the intermediate transfer belt B as an example of the intermediate transfer member by the primary transfer units T1*y*, T1*m*, T1*c*, T1*k*. Residual materials or attachments on the surfaces of the photoconductors PRy, PRm, PRc, PRk after the primary transfer are cleaned by the photoconductor cleaners CLy, CLm, CLc, CLk. The materials which are withdrawn by the photoconductor cleaners CLy to CLk are fed and collected into a collecting container (s) (not shown) by discharge augers HAy to HAk as examples of residual carrying members.

The cleaned surfaces of the photoconductors PRy, PRm, PRc, PRk are re-charged by the chargers CRy, CRm, CRc, CRk.

A belt module BM as an example of an intermediate transfer device is disposed above the photoconductors PRy to PRk. The belt module BM has the intermediate transfer belt B, a belt driving roll Rd as an example of an intermediate transfer member driving member, a tension roll Rt as an example of a tension applying member, a walking roll Rw as an example of a meandering preventing member, an idler roll Rf as an example of a driven member, a backup roll T2*a* as an example of a secondary transfer counter member and the primary transfer units T1*y*, T1*m*, T1*c*, T1*k*. The intermediate transfer belt B is rotatably supported by the respective rolls Rd, Rt, Rw, Rf and T2*a*.

A secondary transfer roll T2*b* as an example of a secondary transfer member is disposed so as to face the surface of the intermediate transfer belt B with which the backup roll T2*a* comes into contact. The backup roll T2*a* and the secondary transfer roll T2*b* constitutes a secondary transfer unit T2. Furthermore, an area where the secondary transfer roll T2*b* faces the intermediate transfer belt B constitutes a secondary transfer area Q4.

Monochromatic or multi-color toner images are successively transferred and superposed onto the intermediate transfer belt B in the primary transfer areas Q3*y*, Q3*m*, Q3*c*, Q3*k* by the primary transfer units T1*y*, T1*m*, T1*c*, T1*k*, and then carried to the secondary transfer area Q4.

The primary transfer units T1*y* to T1*k*, the intermediate transfer belt B, the secondary transfer unit T2, etc. constitute the transfer device T1+T2+B of the exemplary embodiment which transfers images formed on the photoconductors PRy to PRk to medium.

A pair of right and left guide rails GR as an example of a guide member is provided at each of three stages below the visible image forming devices Uy to Uk, and sheet supply trays TR1 to TR3 as an example of a sheet feed tray are mounted on the respective pairs of guide rails GR so as to be insertable and detachable in the front-and-rear direction. Recording sheets S as an example of a medium accommodated in the sheet supply trays TR1 to TR3 are picked up by a pickup roll Rp as an example of a medium pickup member, and separated one by one by a separating roll Rs as an example of a medium separating member. Each of the recording sheets S is transported along a sheet transporting path SH as an example of a medium transporting path by plural transporting rolls Ra as an example of a medium transporting member. The recording sheet S transported by the transporting rolls Ra is disposed at the upstream side of the secondary transfer area Q4 with respect to the sheet transporting direction, and fed to a registration roll Rr as an example of a timing adjusting member for adjusting a transporting timing at which the recording sheet S concerned is transported to the secondary transfer area Q4. The sheet transporting path SH, the sheet transporting roll Ra, the registration roll Rr, etc. constitute a sheet transporting device SH+Ra+Rr.

The registration roll Rr transports the recording sheet S to the secondary transfer area Q4 in conformity with the timing at which a toner image formed on the intermediate transfer belt B is carried to the secondary transfer area Q4. When the recording sheet S passes through the secondary transfer area Q4, the backup roll T2*a* is grounded, and the secondary transfer voltage having the opposite polarity to the charge polarity of toner is applied to the secondary transfer unit T2*b* from the power supply circuit E controlled by the controller C. At this time, the toner image on the intermediate transfer belt B is transferred onto the recording sheet S by the secondary transfer unit T2.

The intermediate transfer belt B after the secondary transfer is cleaned by a belt cleaner CLb as an example of an intermediate transfer member cleaning unit.

The recording sheet S onto which the toner image is secondarily transferred is transported to a fixing area Q5 as a contact area between a heat roll Fh as an example of a heating fixing member and a pressure roll Fp as an example of a pressuring fixing member in a fixing device F, and heated and fixed when it passes through the fixing area. The heated and fixed recording sheet S is discharged from a discharge roller Rh as an example of a medium discharging member to a discharge sheet tray TRh as an example of a medium discharging unit.

The surface of the heat roll Fh is coated with releasing agent by releasing agent coating device Fa so that the recording sheet S can be smoothly separated from the heat roll.

Developer cartridges Ky, Km, Kc, Kk as examples of developer accommodating containers in which respective developer materials of yellow (Y), magenta (M), cyan (C) and black (K) are accommodated are disposed above the belt module BM. The developer accommodated in each of the developer cartridges Ky, Km, Kc, Kk is replenished into each of the developing devices Gy, Gm, Gc, Gk in accordance with the consumption of the developer in each of the developing devices Gy, Gm, Gc, Gk.

(Description of Process Unit and Unit Mounting Portion)

Figure 4:
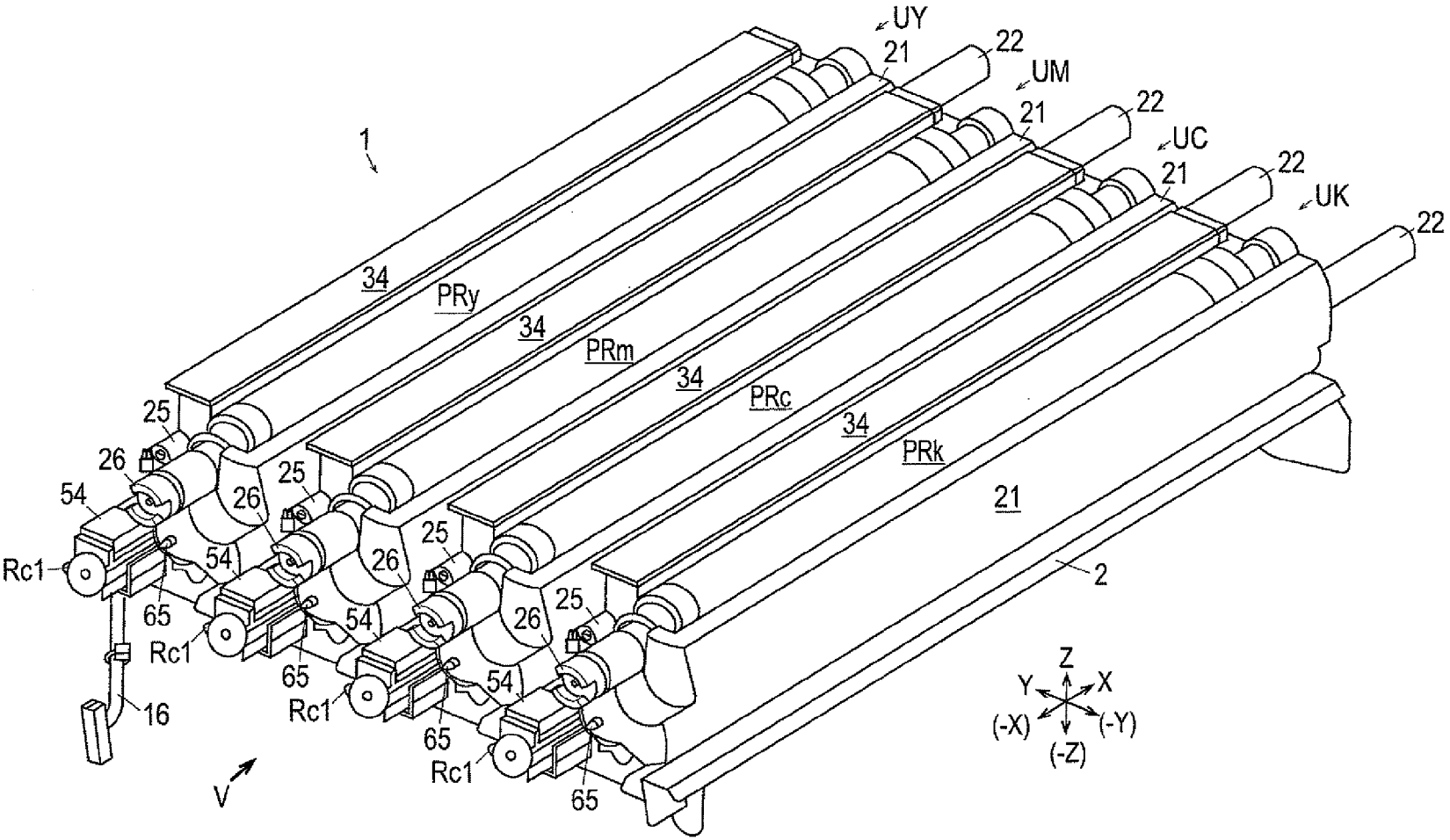
FIG. 4 is a perspective view showing a state that process units of the exemplary embodiment are mounted on the main body of the image forming apparatus when the state is viewed obliquely from the back side.
Figure 5:
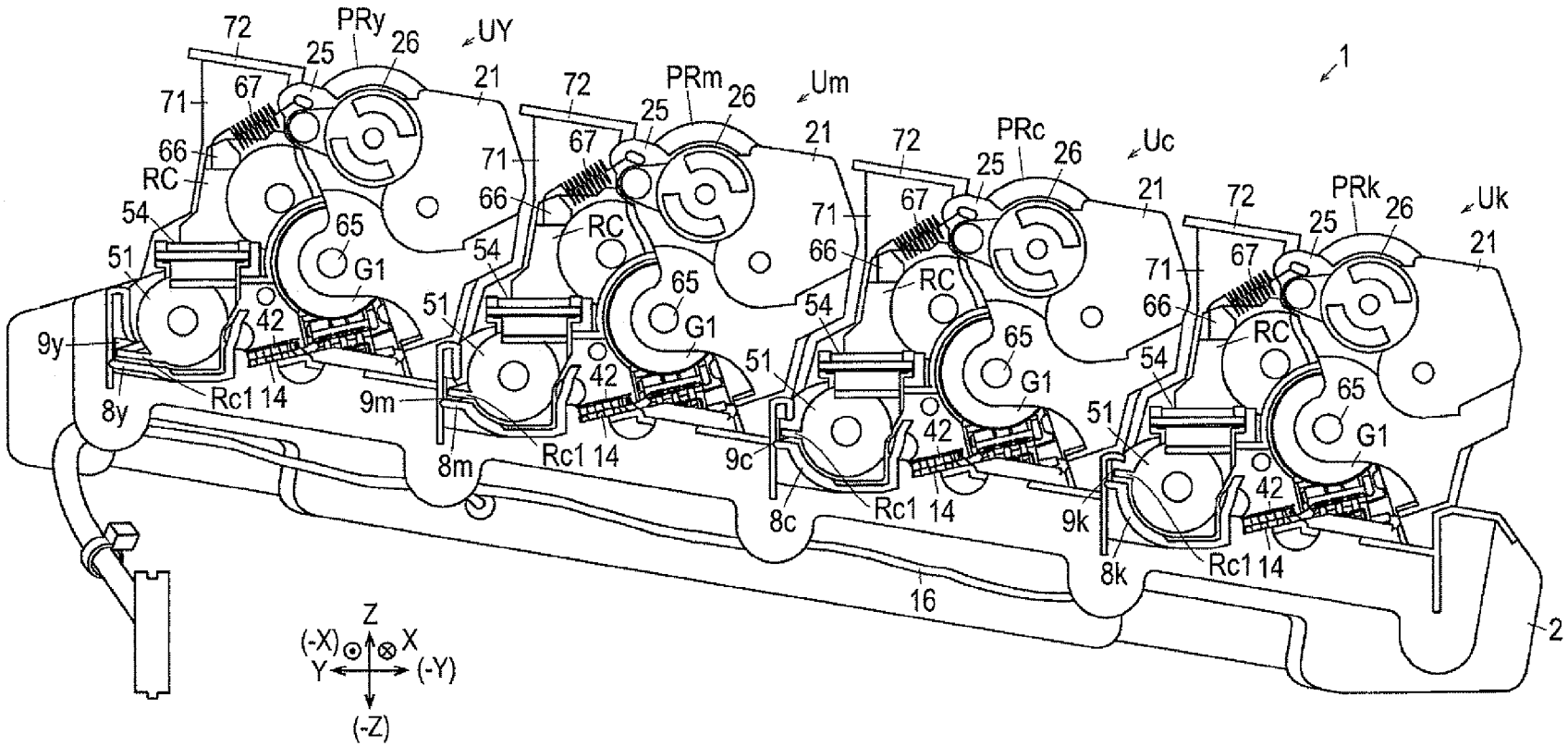
FIG. 5 is a diagram when the state of FIG. 4 is viewed from a direction of an arrow V of FIG. 4.
Figure 6:
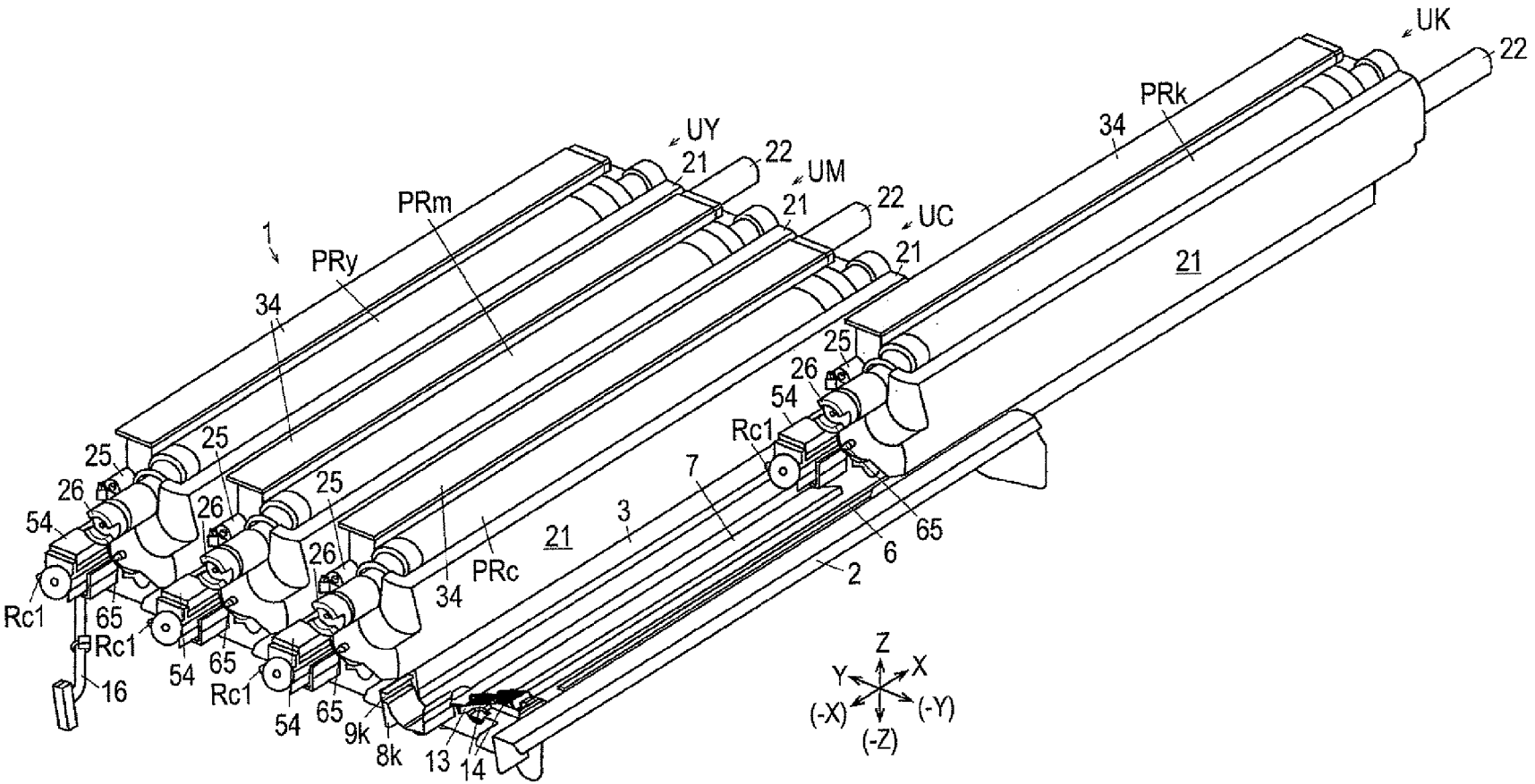
FIG. 6 is a diagram showing a state that a process unit for K color is drawn out forwardly from the state shown in FIG. 4.

FIG. 4 is a perspective view when a state that process units of the exemplary embodiment are mounted in the image forming apparatus main body is viewed obliquely from the back side. FIG. 5 is a view taken along a direction of an arrow V in FIG. 4, FIG. 6 is a diagram showing a state that the process unit of K color is drawn out to the front side from the state shown in FIG. 4, and FIG. 7 is a perspective view of a unit mounting portion under the state that all the process units are detached from the unit mounting portion.

In FIGS. 4 to 7, the unit mounting portion 1 as an example of a detachable member mount portion is supported above the latent image forming device ROS in the image forming apparatus main body U2 of the copying machine U of the exemplary embodiment. The unit mounting portion 1 has four unit supporting portions 2 extending in the front-and-rear direction in connection with the process units UY to UK of Y, C and K as an example of a mount portion main body.

Figure 7:
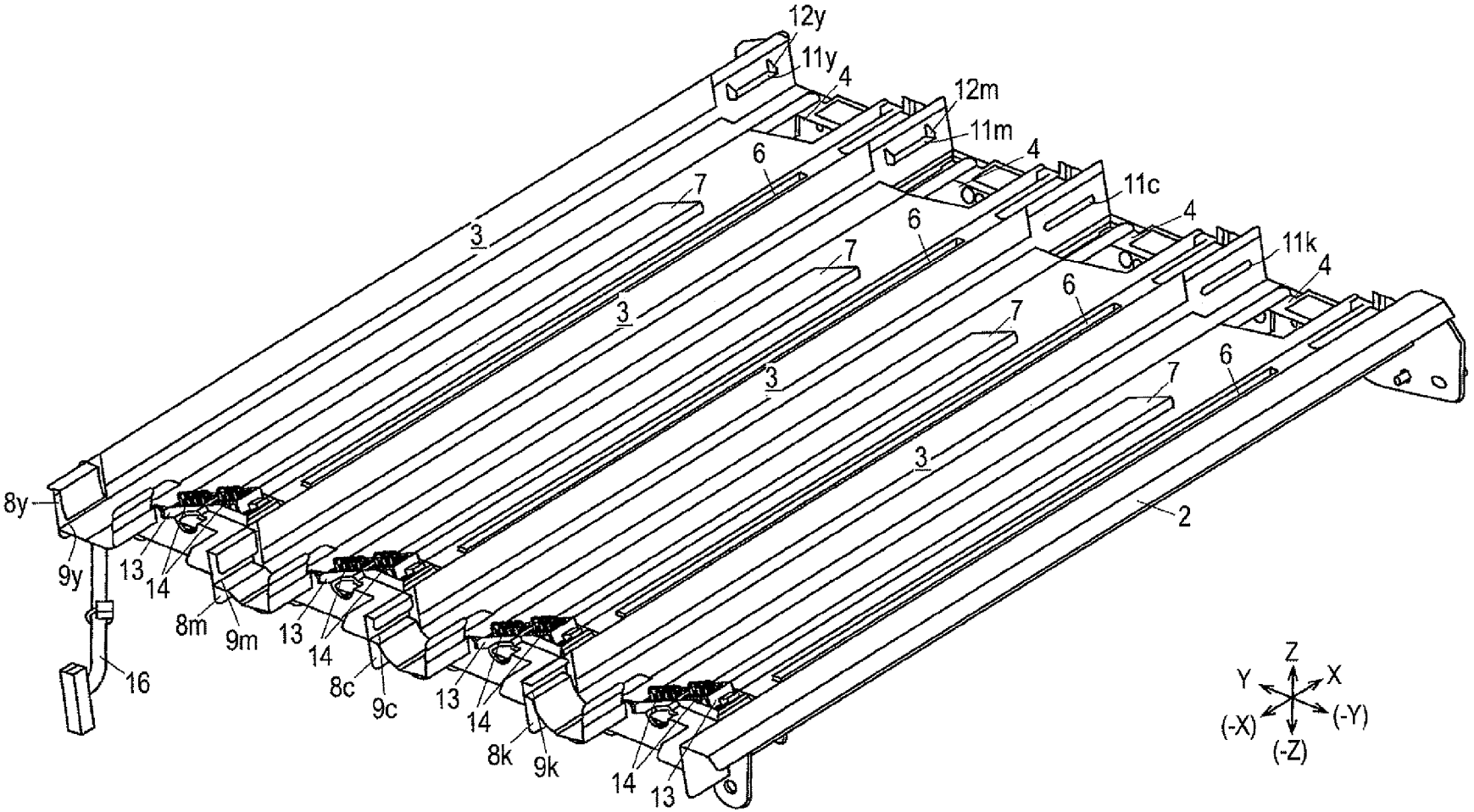
FIG. 7 is a perspective view showing a unit mounting portion under a state that all the process units are detached.

In FIG. 7, walls 3 as an example of partition portions which extend along the unit supporting portions 2 and through which the unit supporting portions 2 are insulated from each other are formed at both the right and left sides of each unit supporting portion 2. A concaved front-end mount portion 4 in which the front end of each of the process units UY to UK is mounted is formed at the front end portion of each unit supporting portion 2. A light passing port 6 which is configured by a through hole extending in the front-and-rear direction and through which each latent image forming light Ly to Lk emitted from the latent image forming device ROS passes is formed at the left side of each unit supporting portion 2. A slant guide surface 7 is configured to be downwardly inclined to the right side, and guides the bottom surface of each of the process units UY to UK which are detachably mounted.

In FIGS. 4 to 7, a rearward projecting color identifying guide 8 as an example of an identifying unit is formed at the right side of the rear end portion of each unit supporting portion 2. In FIGS. 5 and 7, color identifying guides 8*y*, 8*m*, 8*c* and 8*k* of Y, M, C, K are provided with identifying paths 9*y*, 9*m*, 9*c* and 9*k* to identify whether the process units UY to UK to be mounted are fitted or not. The identifying paths 9*y*, 9*m*, 9*c* and 9*k* are respectively formed at different height positions so as to be recessed rightward and extend in the front-and-rear direction. In the exemplary embodiment, the identifying paths 9*y* to 9*k* of Y, M, C and K are successively displaced in height from the lower side to the upper side in this order.

In FIG. 7, a backlash regulating guide 11 which projects leftwards and extends in the front-and-rear direction is formed as an example of a moving regulating unit at the front end portion of the erecting wall 3 at the right side of each unit supporting portion 2 of Y, M, C, K. In the exemplary embodiment, a pair of front and rear interference ribs 12*y*, 12*m* are formed as an example of an identification interfering portion on the upper surfaces of the backlash regulating guides 11*y*, 11*m* of Y and M.

Figure 8:
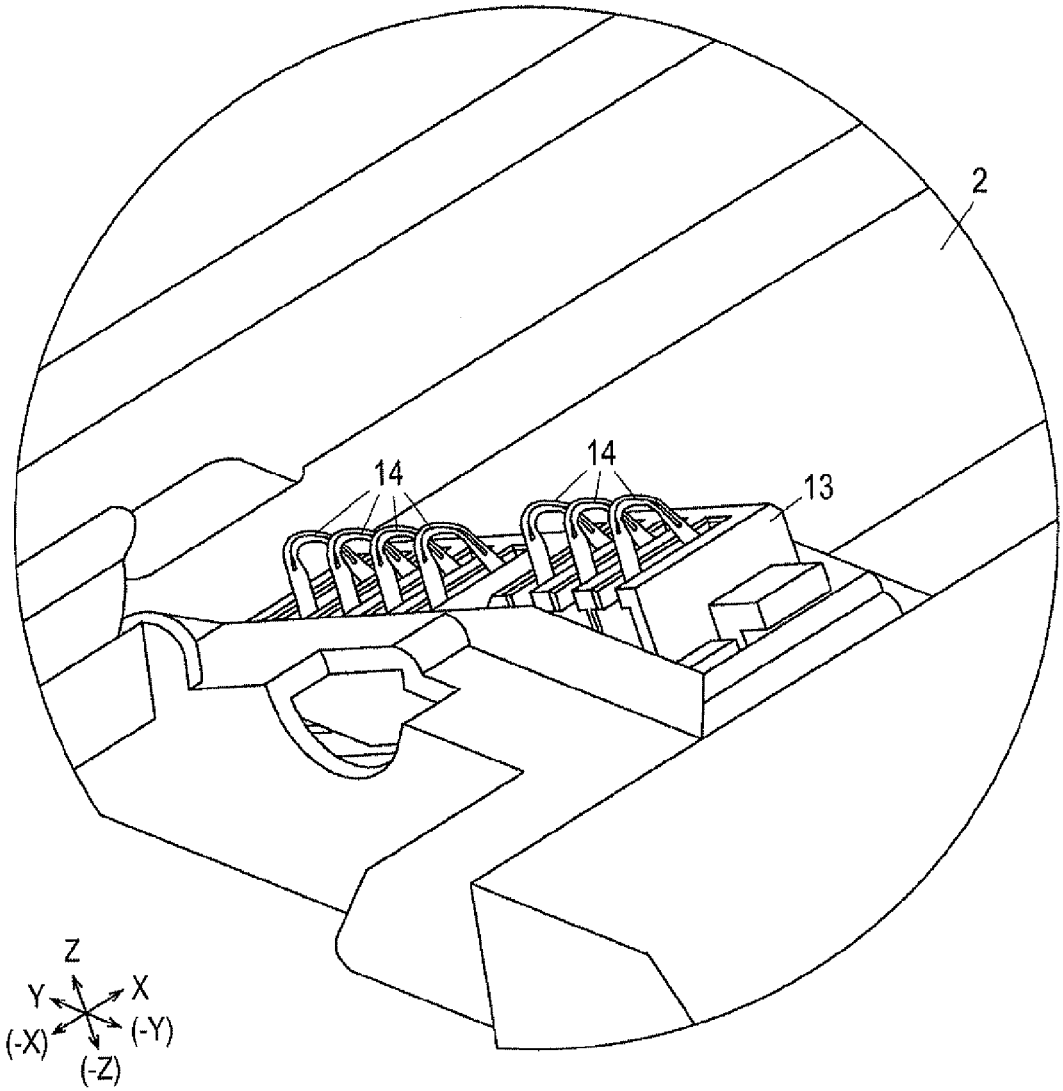
FIG. 8 is an enlarged view of a main part of a connection target terminal portion to be connected at the main body side of the image forming apparatus.

FIG. 8 is an enlarged view showing a main part of a connection target terminal portion at the main body side of the image forming apparatus.

In FIGS. 5, 7 and 8, a main body side connector 13 as an example of a connection target portion is mounted at the left side of the rear end portion of the unit supporting portion 2. The main body side connector 13 has upwardly projecting connector terminals 14 as an example of a connection target terminal, and each connector terminal 14 is formed of metal material and designed like an elastically deformable leaf spring. Each main body side connector 13 is electrically connected to a controller C of the image forming apparatus main body U2 through a harness 16 as an example of a transmission line. The controller C of the image forming apparatus U of the exemplary embodiment is configured by a compact information processing device, so-called a microcomputer, and the controller C has I/O for performing input/output signals to/from the external, adjustment of input/output signal level, etc., ROM for storing programs for executing necessary processing, data, etc., RAM for temporarily storing required data, HDD, CPU for performing processing corresponding to the programs stored in ROM or HDD, a clock oscillator, etc. The controller can implement various functions by executing the programs stored in the ROM.

(Description of Process Unit)

Figure 9:
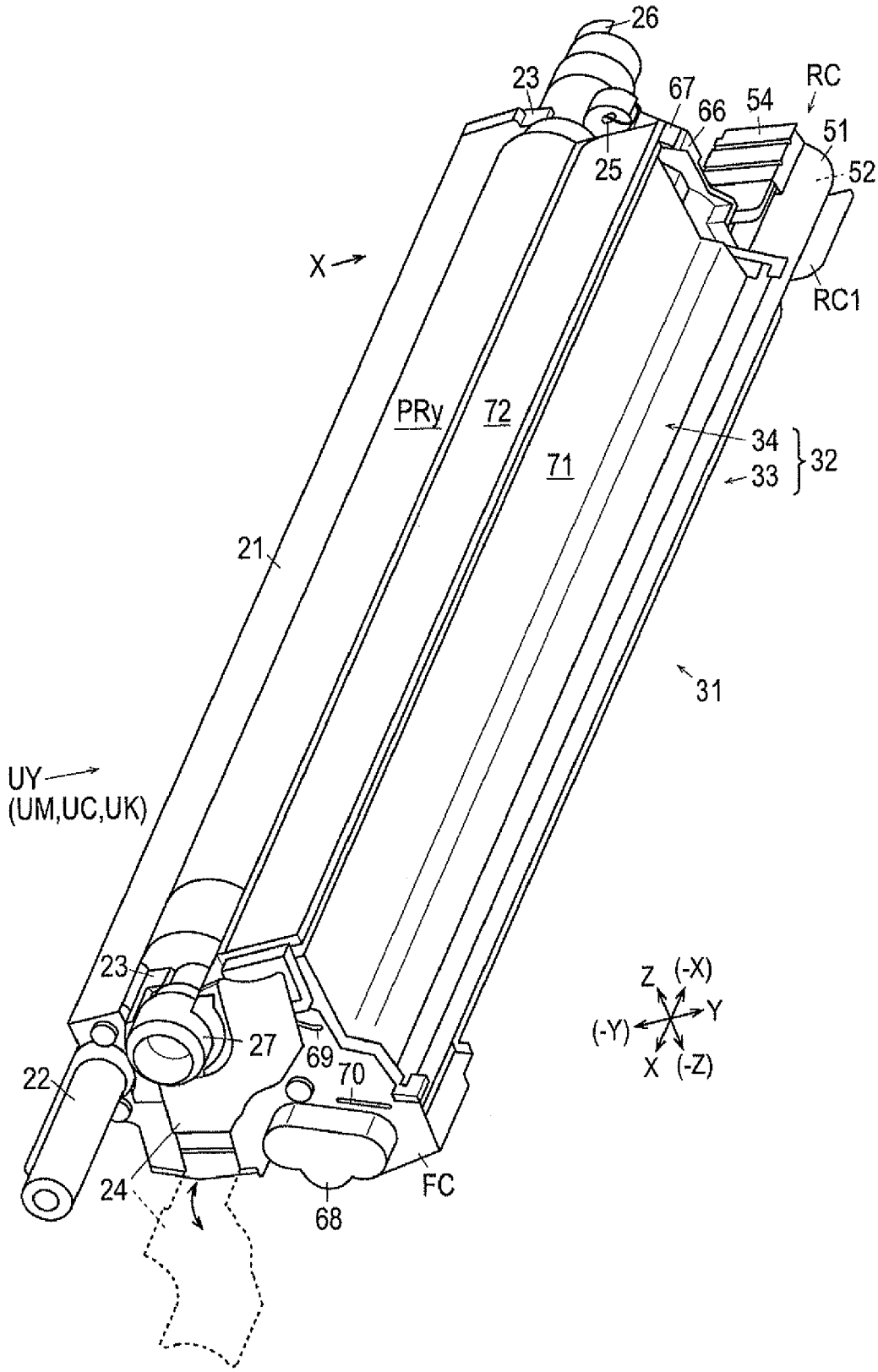
FIG. 9 is a perspective view showing a process unit of the exemplary embodiment.
Figure 10B:
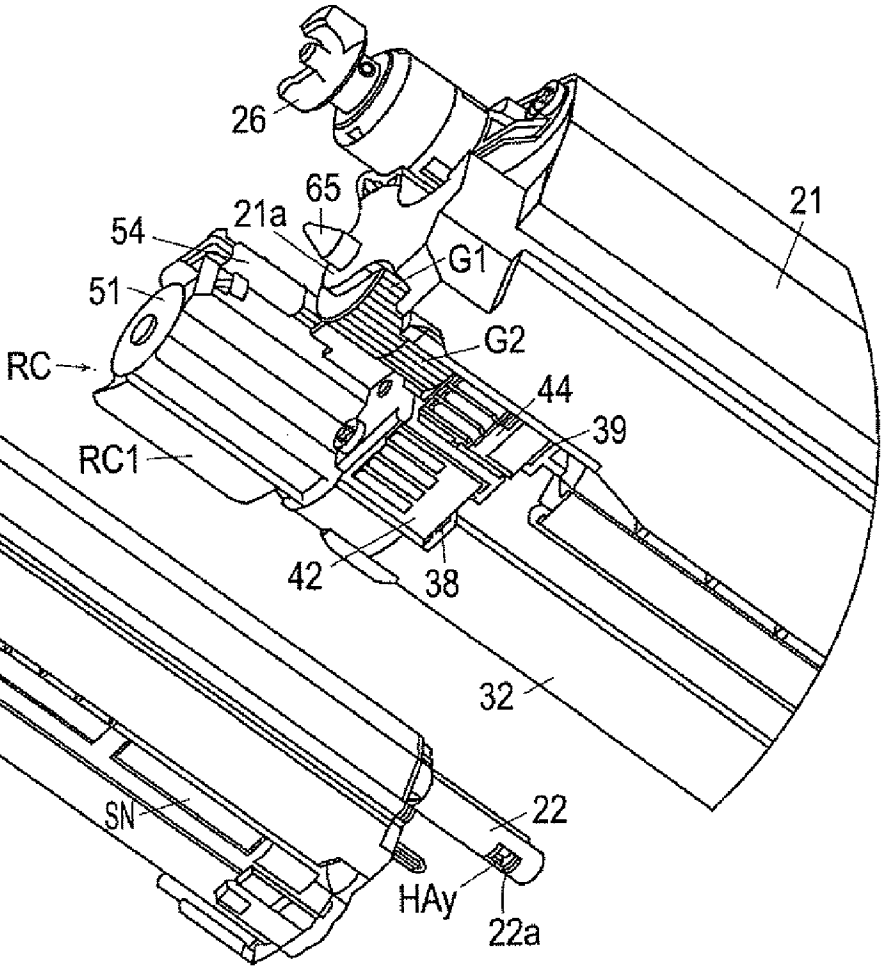
Figure 10A:
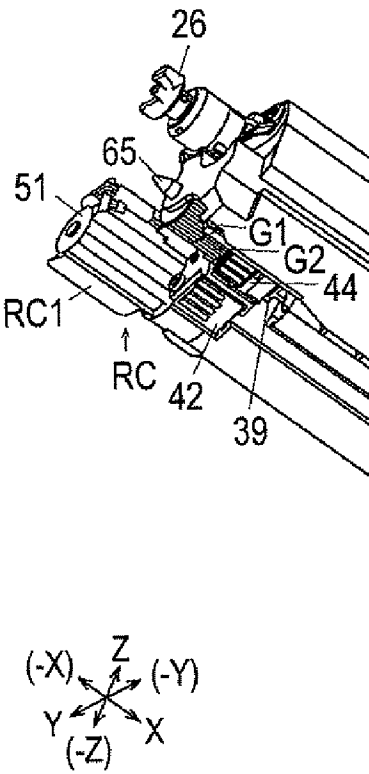

FIG. 9 is a perspective view showing the process unit of the exemplary embodiment, and FIGS. 10A and 10B are diagrams showing the process unit when the process unit is taken along a direction of an arrow X of FIG. 9, wherein FIG. 10A is a diagram showing the overall configuration of the process unit, and FIG. 10B is an enlarged view of a main part of the rear end portion of the process unit.

Next, the process units UY to UK of the exemplary embodiment will be described. Since the respective process units UY to UK have the same configuration, the process unit UY of Y color will be descried in detail, and the detailed description of the other process units UM to UK of the other colors is omitted from the following description.

(Description of Photoconductor Cleaner Unit)

In FIGS. 4, 6, and 9, the process unit UY of the exemplary embodiment has a photoconductor cleaner unit 21 disposed at the left side of the photoconductor PRy. The photoconductor cleaner unit 21 contains a photoconductor cleaner CLy therein. In FIGS. 9 and 10A, a discharge cylinder 22 as an example of a collected material discharging unit is mounted at the front end of the photoconductor cleaner unit 21 so as to extend to the front side, and a collected material discharging port 22*a* which is opened downwardly is formed at the front end of the discharging cylinder 22 as shown in FIG. 10A. When the front panel Ua is closed under the state that the process cartridge is mounted in the image forming apparatus main body U2, the withdrawn material discharging port 22*a* of the discharging cylinder 22 can be connected to a withdrawing container (not shown) disposed inside the front panel Ua. The front end of the discharge auger HAy extending from the photoconductor cleaner unit 21 is mounted in the discharging cylinder 22, and withdrawn materials carried by the discharge auger HAy are discharged from the withdrawn material discharging port 22*a* into the withdrawing container.

In FIG. 9, a pair of front and rear bearing portions 23 for supporting the photoconductor PRy rotatably are integrally formed at both the front and rear end portions of the photoconductor cleaner unit 21. A lever 24 as an example of an operating unit which is used when a worker handles the process units UY to UK is mounted at the lower end of the front end portion of the photoconductor cleaner unit 21. As indicted by a solid line and a broken line in FIG. 9, the lever 24 of the exemplary embodiment is mounted so as to be rotatable around the lower end thereof.

Furthermore, a tracking spring supporting portion 25 as an example of an urging supporting portion is formed at the upper right end portion of each bearing portion 23. In FIG. 9, only the tracking spring supporting portion 25 at the rear side is illustrated, however, the tracking spring supporting portion 25 at the front side is disposed behind the lever 24, and has the same configuration as the tracking spring supporting portion 25 at the rear side, so that the tracking spring supporting portion 25 at the front side is omitted from the illustration.

In FIGS. 9, 10A and 10B, a coupling 26 as an example of a transmission member to which driving force is transmitted under a state that the process unit UY is mounted is mounted at the rear end of the photoconductor PRy. The coupling 26 is engaged with a coupling (not shown) provided to the image forming apparatus main body U2, whereby driving force is transmitted from a driving force source to the coupling 26.

In FIG. 9, a positioning cap 27 as an example of a positioning target member is mounted at the front end of the photoconductor PRy. The positioning cap 27 has a recess portion formed at the front end thereof, and a front-side projection (not shown) is fitted in the recess portion under the state that the front panel Ua is closed, whereby the positioning cap 27 is positioned. Accordingly, under the state that the process unit UY of the exemplary embodiment is mounted in the image forming apparatus main body U2 and the front panel Ua is closed, the process unit UY is mounted while positioned by the coupling 26 and the positioning cap 27.

(Description of Developing Unit)

Figures 11A, 11B:
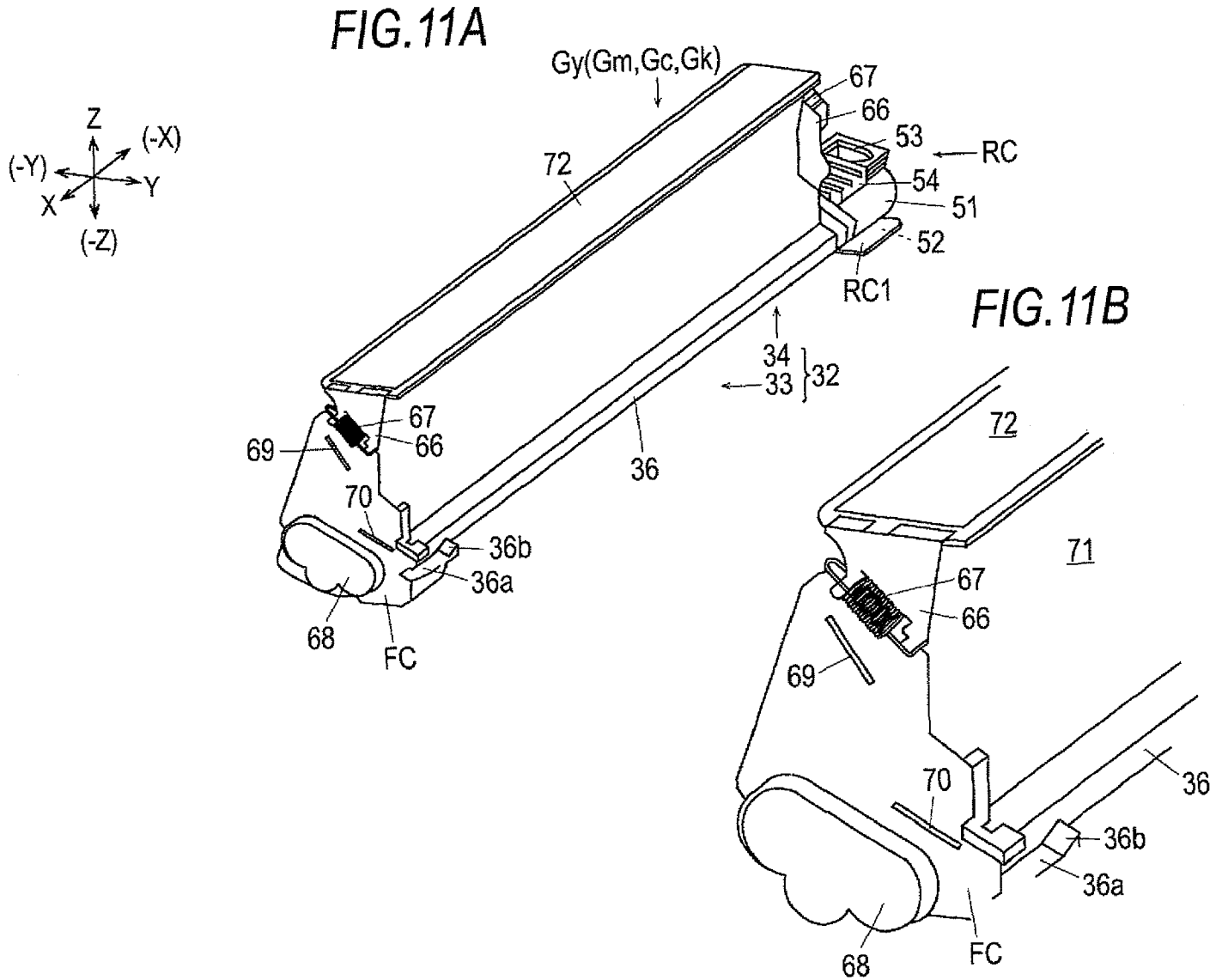

FIGS. 11A and 11B are perspective views of a developing unit when it is viewed obliquely from the front right side, wherein FIG. 11A is a perspective view showing the overall configuration, and FIG. 118 is an enlarged view of a front end portion.

Figure 12:
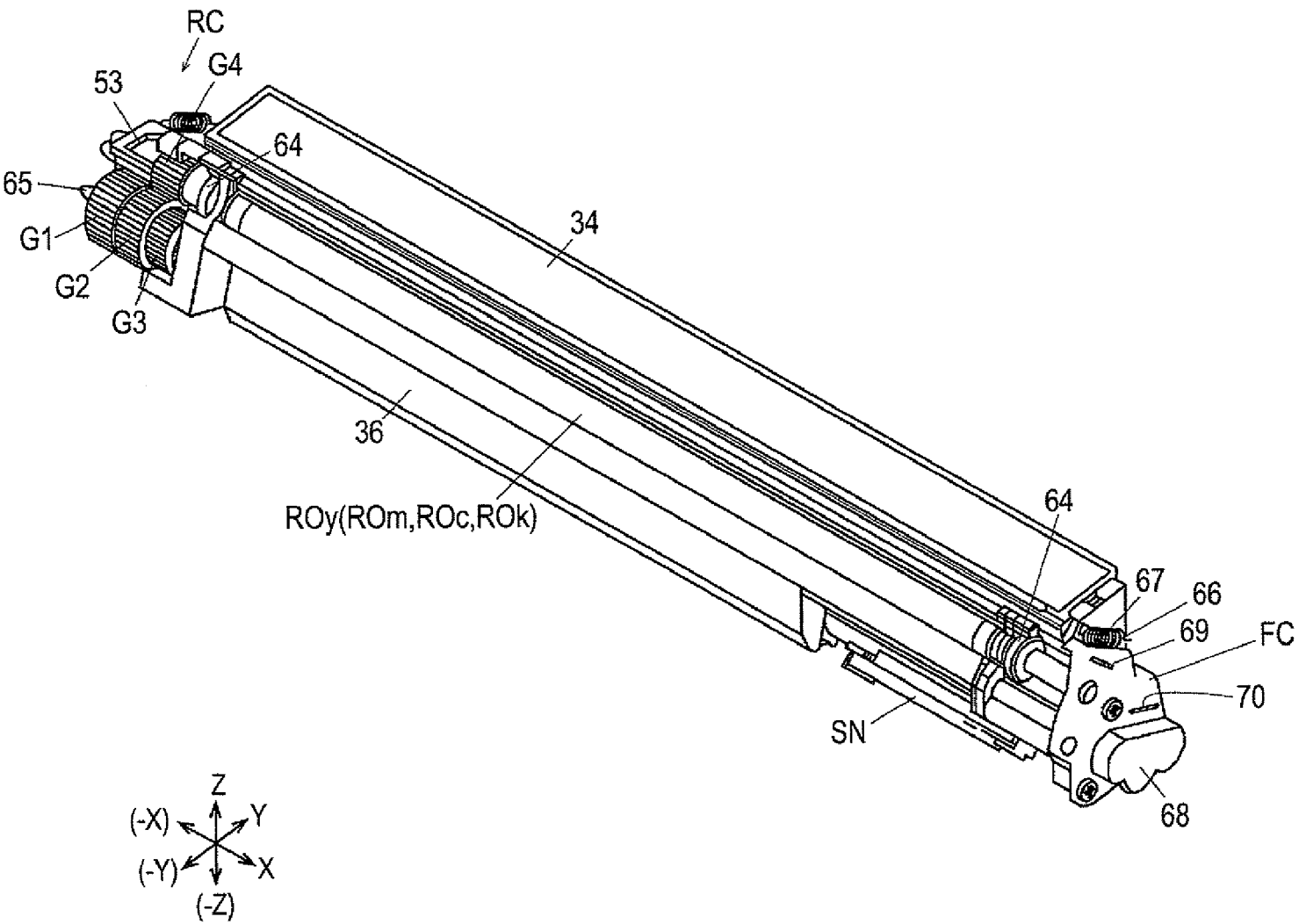
FIG. 12 is a perspective view showing the developing unit when the developing unit is viewed obliquely from the upper left front side.

FIG. 12 is a perspective view of the developing unit when it is viewed obliquely from the front left side.

In FIG. 9, a developing unit 31 as an example of a developing device extending in the front-and-rear direction corresponding to the width direction of the recording sheet S is disposed at the right side of the photoconductor PRy. In FIGS. 5, 9, 11A, 11B and 12, the developing unit 31 of the exemplary embodiment has a unit main body 32 extending in the front-and-rear direction, a front cover FC as an example of a front coating member mounted at the front end of the unit main body 32, and a rear cover RC as an example of a rear coating member mounted at the rear end of the unit main body 32.

(Description of Developing Housing)

Figure 13:
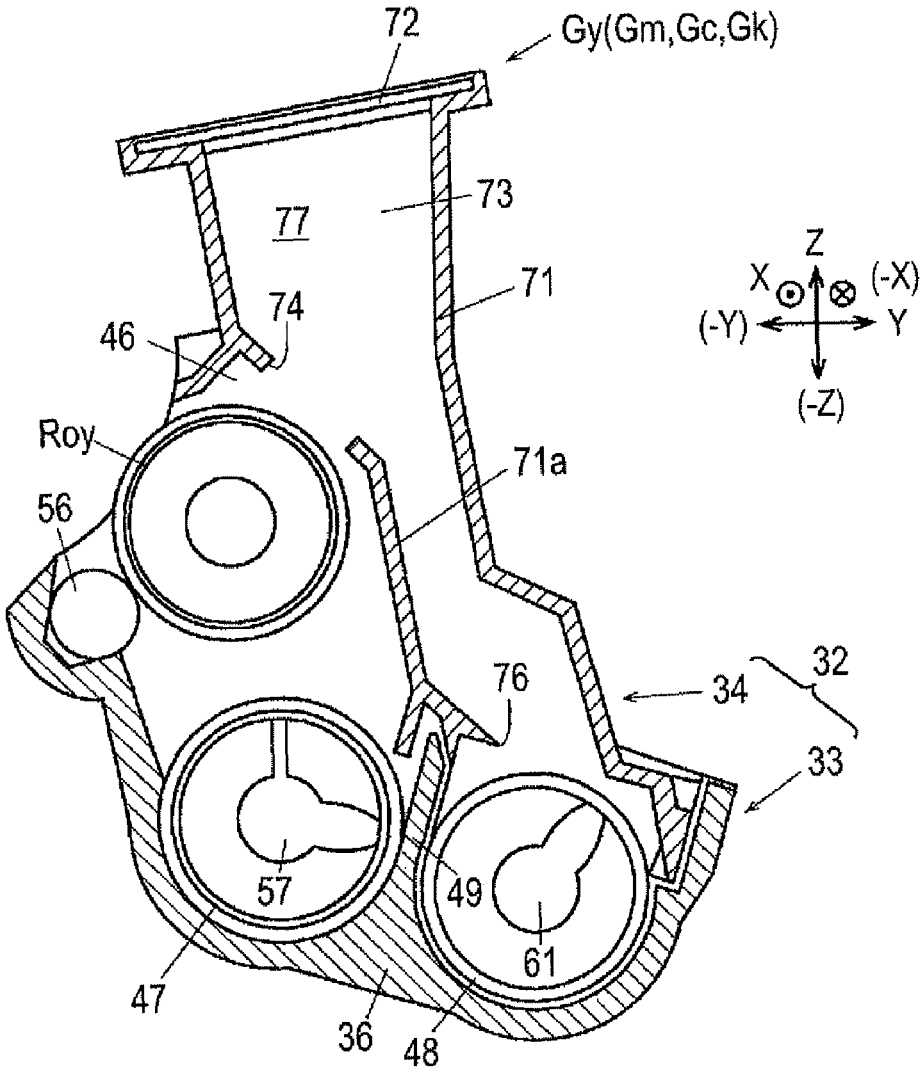
FIG. 13 is a cross-sectional view of the developing unit.
Figures 14A, 14B, 14C:
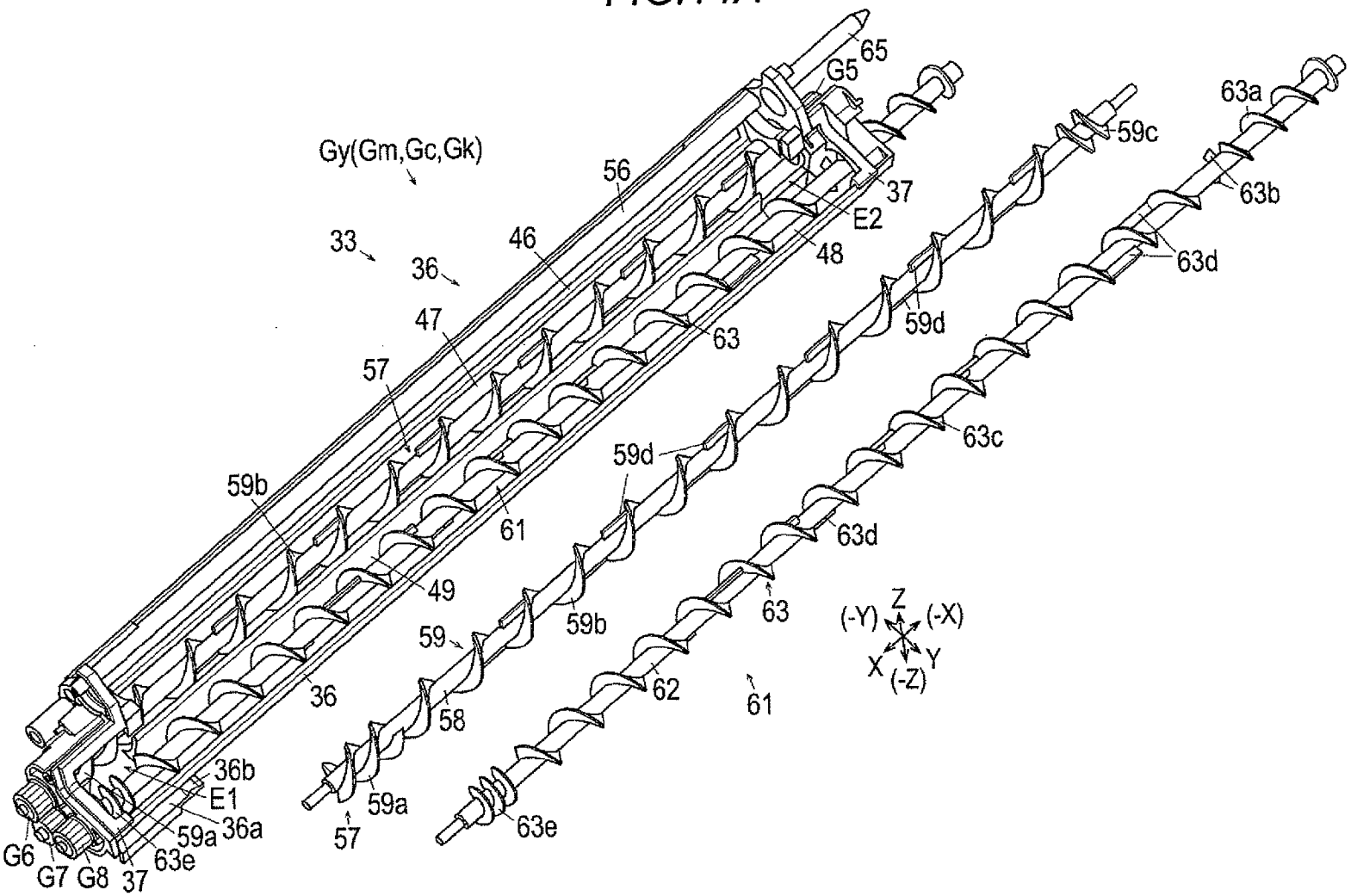

FIG. 13 is a cross-sectional view of the developing device. FIGS. 14A to 14C are diagrams showing a main part of the developing unit main body, wherein FIG. 14A is a perspective view showing the developing unit main body under a state that a developing roll and an initial developer container are detached, FIG. 14B is a perspective view of a supply auger, and FIG. 14C is a perspective view of an admix auger.

In FIG. 9 and FIGS. 11A to 13, the unit main body 32 of the exemplary embodiment has a developing member 33 disposed at the lower portion thereof and a starter accommodating unit 34 as an example of a developer housing portion mounted at the upper side of the developing member 33.

In FIGS. 13 and 14A, the developing member 33 has a developing housing 36 in which developer is accommodated.

In FIG. 14A, a protrusion portion 36*a* having a plate-like shape which protrudes to the right side in connection with the backlash regulating guide 11 and extends in the front-and-rear direction is formed at the front end portion of the outer right surface of the developing housing 36. A backlash regulating projection 36*b* as an example of a regulation target portion is formed at the rear end of the protrusion portion 36*a*. The backlash regulating projection 36*b* is configured to project upwardly so that it can come into contact with the lower surface of the backlash regulating guide 11*y*. When the process unit UY is mounted, the backlash regulating projection 36*b* comes into contact with the backlash regulating guide 11*y* to position the process unit UY, thereby regulating the backlash of the process unit UY.

In FIG. 14A, a developing housing seal 37 as an example of a leakage preventing member for preventing leakage of developer from the inside of the developing housing 36 is provided to each of the upper surfaces of the front and rear end portions of the developing housing 36 so as to extend along the edges of the upper surfaces concerned. The developing housing seal 37 of the exemplary embodiment is formed of sponge which is an example of an elastic material and also an example of an expandable material. However, the developing housing seal of this exemplary embodiment is not limited to this material, and any sealing material such as rubber, cloth or the like may be used.

(Description of Connection Terminal of Developing Unit)

Figure 15A:
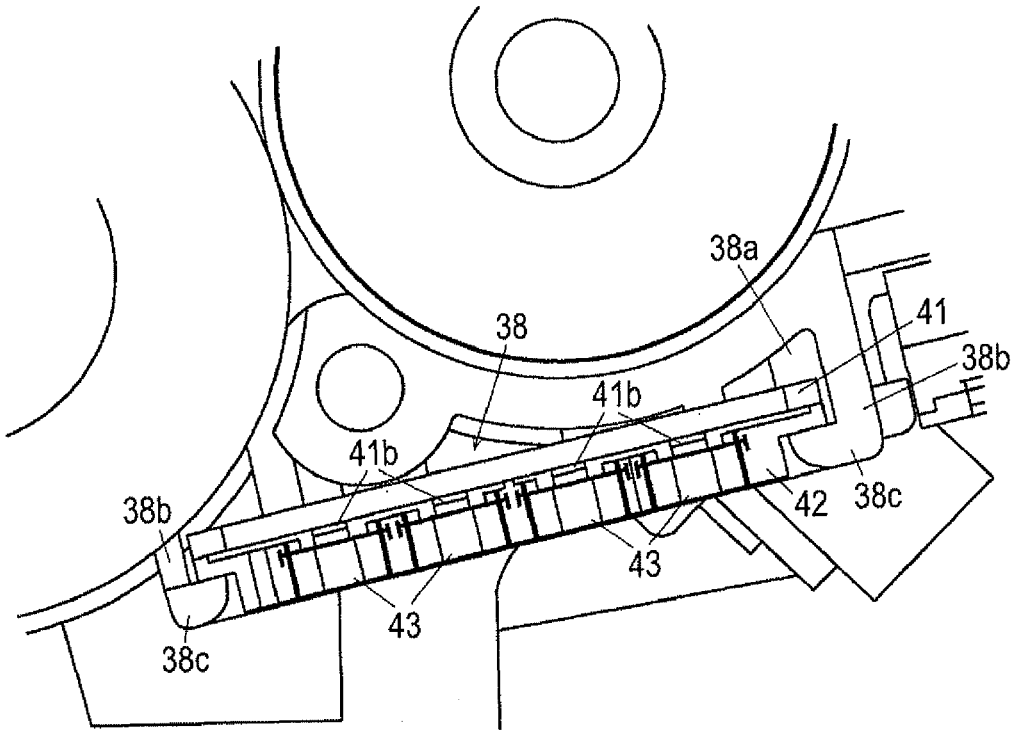
Figure 15B:
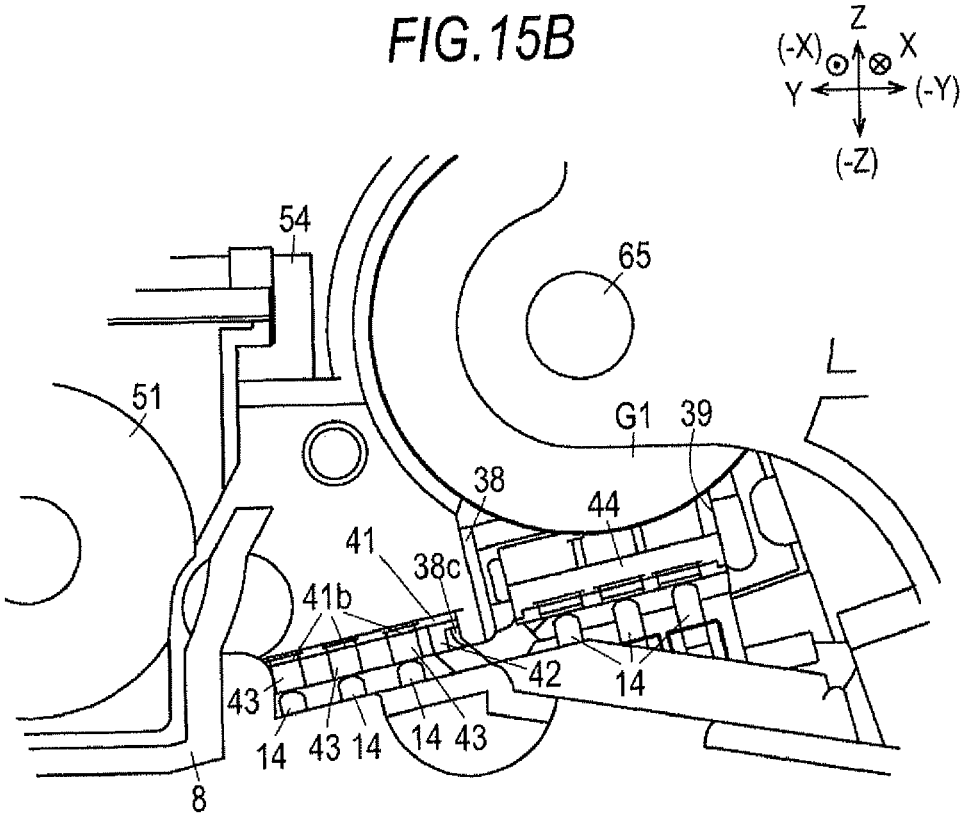
Figure 16:
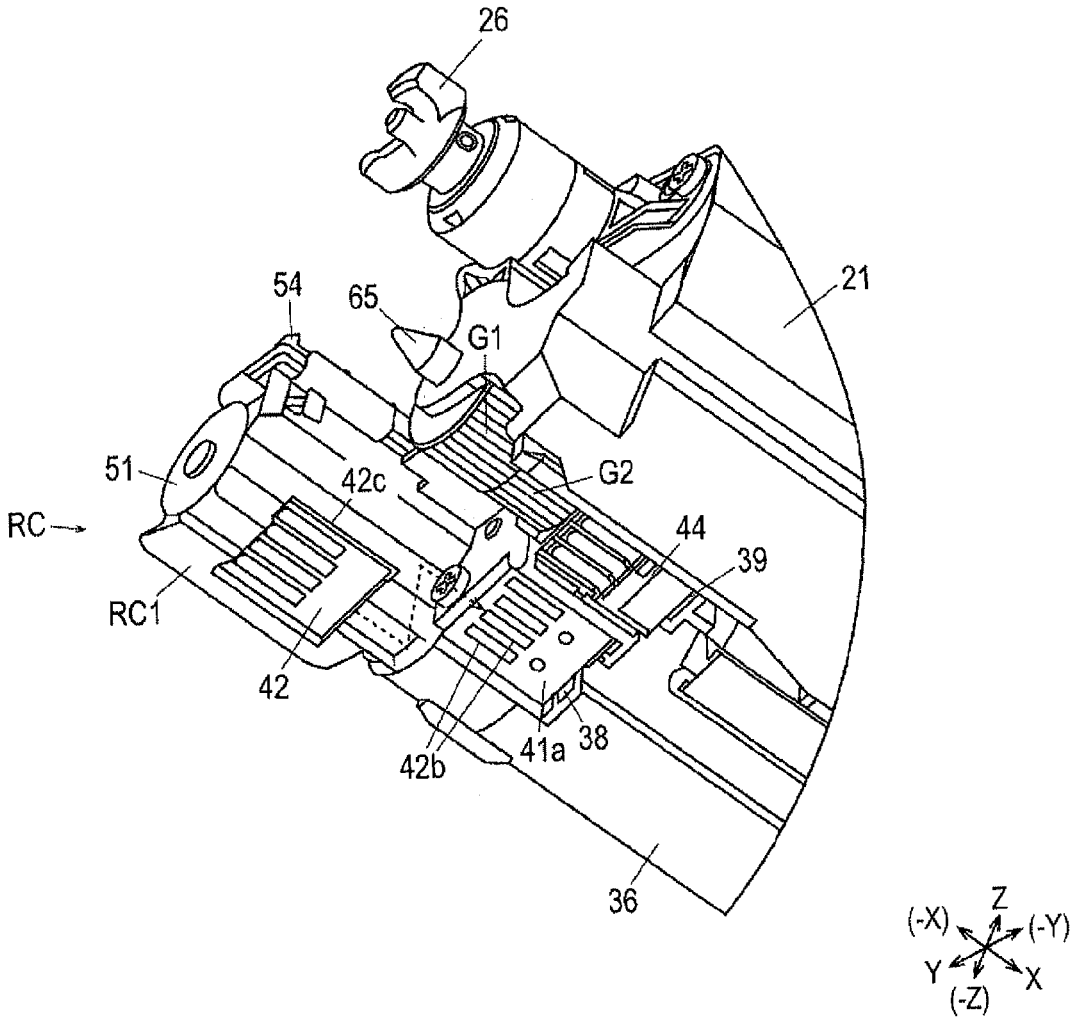
FIG. 16 is a diagram showing a state that a protection member is detached from the process unit.

FIGS. 15A and 15B are enlarged views showing a main part of the connection terminal, wherein FIG. 15A is a diagram showing a main part under a state that the connection terminal is connected to the connection target terminal at the main body side, and FIG. 15B is a diagram showing the main part under a state that the connection terminal is connected to the connection target terminal at the main body side. FIG. 16 is a diagram showing a state that a protection member is detached from the process unit.

In FIGS. 10A and 10B, FIGS. 15A and 15B and FIG. 16, a right-side CRUM mount portion 38 and a left-side terminal mount portion 39 as an example of a medium supporting portion are formed on the lower surface of the rear end portion of the developing housing 36.

In FIG. 15A, the CRUM mount portion 38 has a downwardly opened mounting space 38*a*, a pair of right and left side wall portions 38*b* which extend downwardly from both the right and left sides of the mounting space 38*a*, and holding pawls 38*c* as an example of holding portions each of which extends from the lower end of each side wall portion 38*b* to the inside of each side wall portion 38*b*. The terminal mount portion 39 at the left side has the same configuration as the CRUM mounting unit 38, and thus the detailed description thereof is omitted.

Figure 17B:
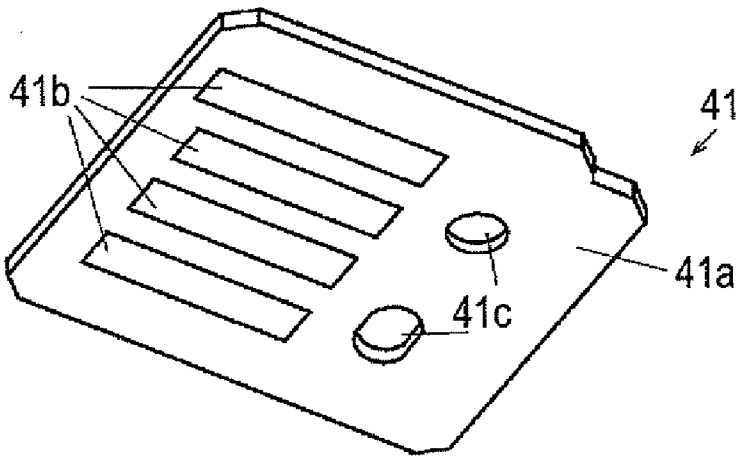
FIGS. 17A and 17B are a plan view and a perspective view showing a storage medium of the exemplary embodiment, respectively.
Figure 17A:
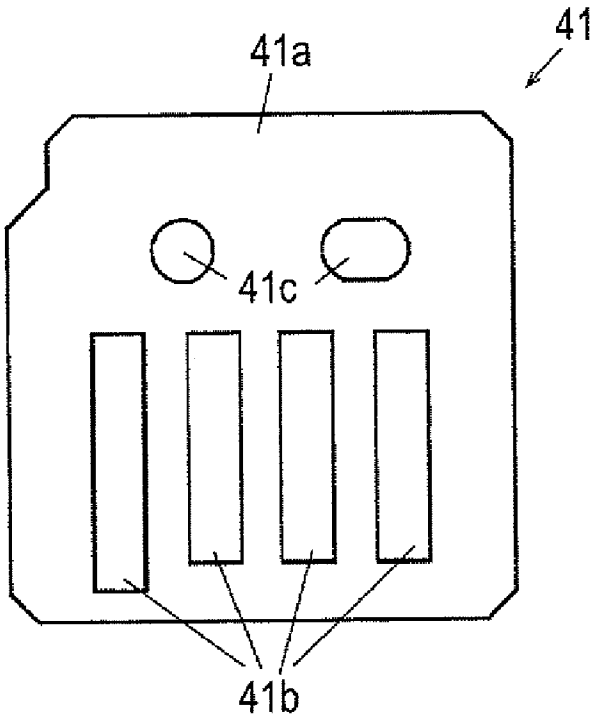

FIGS. 17A and 17B are diagrams showing a storage of the exemplary embodiment, wherein FIG. 17A is a plan view of the storage, and FIG. 17B is a perspective view of the storage.

In FIGS. 10A and 10B, FIGS. 15A and 15B and FIG. 16, CRUM (Customer Replaceable Unit Memory) 41 as an example of the storage and a CRUM adaptor 42 as an example of the protection member are detachably mounted in the CRUM mounting unit 38. In FIG. 16 and FIGS. 17A and 17B, CRUM 41 of the exemplary embodiment has a plate-like board 41*a* in which a storage element (not shown) for storing information is mounted, and four connection terminals 41*b* as electrical contact points which are exposed on the surface of the board 41*a*. In CRUM 41 of the exemplary embodiment are stored information on the color of the developer accommodated in the process cartridge UY and information concerning the process cartridge UY such as a use state such as accumulated rotational time of the photoconductor PRy. Circular and elongated fixed holes 41*c* are formed as an example of a fixing unit in the board 41*a*, and when CRUM 41 is mounted in the CRUM mount portion 38, projections formed in the CRUM mount portion 38 are fitted in the circular and elongated fixed holes 41*c*, whereby the CRUM 41 can be positioned and prevented from dropping out.

In the exemplary embodiment, the board 41*a* of CRUM 41 is formed of epoxy resin as an example of resin material. The connection terminals 41*b* are formed by plating epoxy resin with gold as an example of an electrically conductive metal material. That is, the connection terminals 41*b* are formed by gold-plating. In the exemplary embodiment, the thickness of gold plating is set to 0.03 μm, for example, however, it may be arbitrarily changed in accordance with the design, the specification or the like.

Figure 18A:
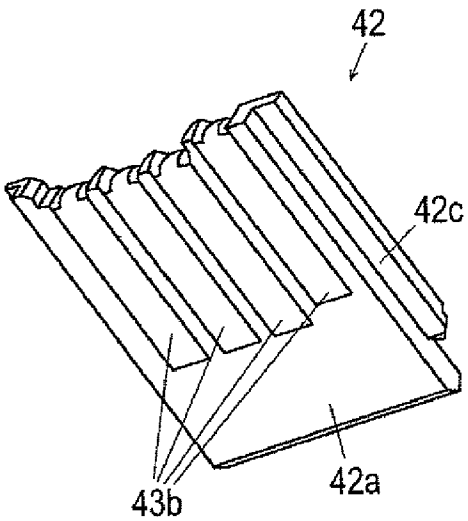
Figure 18B:
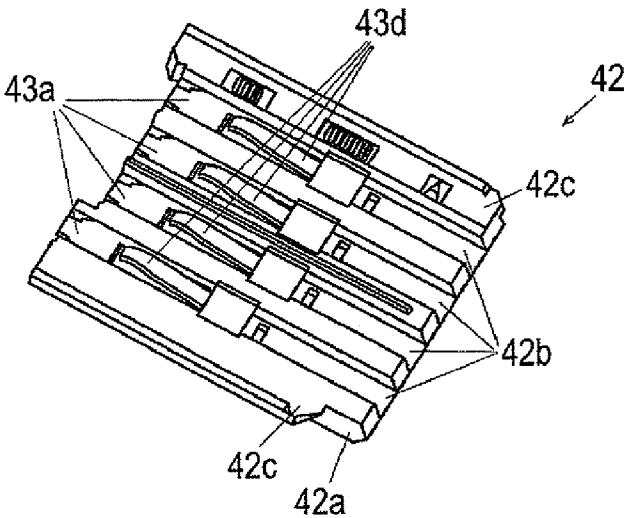
Figure 18C:
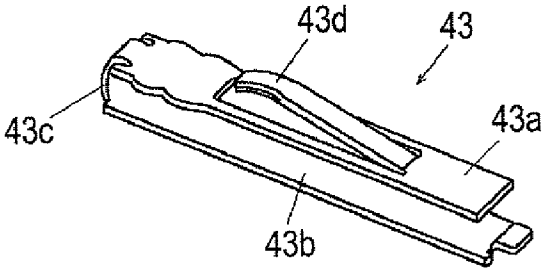

FIGS. 18A to 18C are diagrams showing the protection member of the exemplary embodiment, wherein FIG. 18A is a perspective view of the protection member when it is viewed obliquely from the lower side, FIG. 18B is a perspective view of the protection member when it is viewed obliquely from the upper side, and FIG. 18C is a perspective view of a protection connection terminal.

In FIGS. 10A and 10B, FIG. 16 and FIGS. 18A to 18C, the CRUM adaptor 42 of the exemplary embodiment has a flat-plate type adaptor main body 42*a* as an example of a protection member main body. In FIG. 18B, four terminal mount grooves 42*b* are formed on the upper surface of the adaptor main body 42*a* so as to extend along the front-and-rear direction and correspond to the connection terminals 41*b* of CRUM 41. In FIGS. 18A and 18B, holding ribs 42*c* as an example of holding target portions are formed at both the right and left sides of the adaptor main body 42*a* so as to protrude outwardly in the right-and-left direction. As shown in FIG. 15A, the holding ribs 42*c* are held by the holding pawls 38*c*, whereby the CRUM adaptor 42 is detachably mounted in the CRUM mount portion 38.

In FIGS. 18A and 18B, a connector member 43 as an example of a protection connection member is fixedly mounted on each terminal mount groove 42*b*. In FIG. 18C, the connector member 43 has an upper CRUM connection terminal 43*a* as an example of a first protection connection terminal, a lower main body connection terminal 43*b* as an example of a second protection connection terminal, and a connection portion 43*c* for connecting the respective front ends of the connection terminals 43*a* and 43*b* as electrical contact points, and the connector member 43 is configured in U-shape so that the adaptor main body 42*a* is pinched by the CRUM connection terminal 43*a* and the main body connection terminal 43*b*. The CRUM connection terminal 43*a* is provided with a contact portion 43*d* which is configured like an upwardly-extending leaf spring so as to come into contact with the connection terminal 41*b* of CRUM 41.

The connector member 43 of the exemplary embodiment is formed of phosphor bronze as an example of metal material because plated gold is more hardly exfoliated from phosphor bronze as compared with epoxy resin, and gold as an example of electrically conductive metal material is plated on the contact portion 43*d* and the surfaces containing the lower surface of the main body connection terminal 43*b*. Furthermore, in the exemplary embodiment, the thickness of plated gold is set to 0.3 μm, for example, and it may be arbitrarily changed in accordance with the design, specification or the like.

Accordingly, in the process cartridge UY of the exemplary embodiment, the CRUM adaptor 42 is mounted under the state that CRUM 41 is mounted in the CRUM mount portion 38, whereby CRUM 41 is held in the CRUM mount portion 38. Under the state that CRUM 41 and the CRUM adaptor 42 are mounted, the contact portions 43*d* of the CRUM adaptor 42 are brought into contact with the connection terminals 41*b* of CRUM 41, and thus the connector member 43 and CRUM 41 are electrically conducted to each other.

When the process cartridge UY is mounted in the image forming apparatus main body U2, the main body connection terminals 43*b* of the CRUM adaptor 42 come into contact with the connector terminals 14 at the right side of the main body side connector 13, and the controller C of the image forming apparatus main body U2 and CRUM 41 are electrically connected to each other, whereby information transmission/reception can be performed.

In the exemplary embodiment, the contact force between the leaf-spring type contact portion 43*d* and the connection terminal 41*b* is set to 0.15[N], and the leaf-spring type connector terminal 14 and the main body connection terminal 43*b* of the CRUM adaptor 42 is set to 0.3[N]. That is, the contact force between the CRUM adaptor 42 and CRUM 41 is set to be smaller than the contact force between the main body side connector 13 and the CRUM adaptor 42.

A connection terminal 44 which has gold-plated phosphor bronze as in the case of the CRUM adaptor is detachably mounted in the terminal mount portion 39, and when the process cartridge UY is mounted in the image forming apparatus main body U2, the connection terminal 44 is disposed so as to be allowed to come into contact with the connector terminals 14 at the left side of the main body side connector 13.

In FIG. 12, a density sensor SN as an example of a density detecting member for detecting the density of developer, that is, the ratio of toner and carrier contained in the developer at a front end portion of a first stirring chamber 47 described later is mounted at the lower left side of the front end portion of the developing housing 36 in the developing unit 33 of the exemplary embodiment. The density sensor SN is electrically connected to the connection terminal 44 mounted at the rear end portion of the developing housing 36 through a conducting wire (not shown), whereby the density sensor SN can be supplied with power and transmit the detected density of the developer to the controller C.

(Description of Interior of Developing Housing)

In FIGS. 13 and 14, a developing roll mount chamber 46 in which a developing roll R0*y* as an example of a rotator is mounted is formed as an example of a holder mount portion at the upper left portion of the inside of the developing housing 36. A first stirring chamber 47 is disposed below the developing roll mount chamber 46 so as to be adjacent to the developing roll mount chamber 46, and a second stirring chamber 48 is disposed at the obliquely lower right side of the first stirring chamber 47 so as to be adjacent to the first stirring chamber 47.

The first stirring chamber 47 and the second stirring chamber 48 are separate from each other by a partition wall 49 extending in the front-and-rear direction. A first inlet portion E1 through which developer can flow from the second stirring chamber 48 to the first stirring chamber 47 is formed at the front end of the partition wall 49, and a second inlet portion E2 through which developer can flow from the first stirring chamber 47 to the second stirring chamber 48 is formed at the rear end of the partition wall 49. In FIG. 14A, the lengths of the first and second stirring chambers 47 and 48 of the exemplary embodiment are set to be longer at the front side than the developing roll chamber 46.

In FIGS. 9 to 12, a rear cover RC of the developing housing 36 has a cylindrical replenishing unit 51 disposed on an extension of the rear side of the second stirring chamber 48. A replenishing chamber 52 connected to the second stirring chamber 48 is formed in the replenishing unit 51, and a replenishing port 53 is formed on the upper surface of the rear end of the replenishing unit 51.

A replenishing port shutter 54 as an example of an opening/closing member for opening/closing the replenishing port 53 is mounted on the upper surface of the replenishing unit 51 so as to be movable in the front-and-rear direction. Accordingly, when the process cartridge UY is mounted in the image forming apparatus main body U2, the replenishing port shutter 54 is pushed by a replenishing system (not shown) for replenishing developer of the developer cartridge Ky provided to the image forming apparatus main body U2, and the replenishing port shutter 54 is moved from a closing position shown in FIG. 9 to an opening portion shown in FIGS. 11 and 12, whereby the developer is allowed to be replenished from the developer cartridge Ky into the replenishing port 53.

(Description of Members Mounted in Developing Housing)

In FIG. 13, the developing roll R0*y* is mounted in the developing roll mount chamber 46, a column-shaped layer thickness regulating member 56 for regulating the thickness of a developer layer attaching to the surface of the developing roll R0*y* is disposed at the obliquely lower left side of the developing roll R0*y* so as to face the surface of the developing roll R0*y*.

A supply auger 57 as an example of a first stirring member is mounted in the first stirring chamber 47. The supply auger 57 has a rotational shaft 58 extending in the front-and-rear direction, and a carry vane 59 formed on the outer periphery of the rotational shaft 58. When the supply auger 57 is rotated, the supply auger 57 carries developer in the first stirring chamber 47 in a first carry direction from the first inlet portion E1 to the second inlet portion E2 while stirring the developer, thereby supplying the developer to the developing roll R0*y*.

The carry blade 59 of the supply auger 57 of the exemplary embodiment is configured by a spiral blade, and the front end thereof, that is, the upstream end thereof in the first carry direction is configured by a double spiral. The carry blade 59 has a high-speed carry portion 59*a* for carrying developer scooped through the first inlet portion E1 to the downstream side at a higher speed as compared with a single spiral. A first main carry portion 59*b* which is configured by a single spiral and supplies the developer to the developing roll R0*y* while carrying the developer to the second inlet portion E2 is disposed at the rear side of the high-speed carry portion 59*a* so as to face the developing roll R0*y*. A first reverse carry portion 59*c* for making developer at the downstream end of the first stirring chamber 47 to the second inlet portion E2 is disposed at the rear side of the first main carry portion 59*b*. The first reverse carry portion 59*c* is configured by a spiral whose winding direction is opposite to that of the first main carry portion 59*b*. Plural plate-shaped stirring portions 59*d* which extend along the axial direction of the rotational shaft 58 and stir developer are disposed in an area where the first main carry portion 59*b* of the supply auger 57 is provided.

In FIGS. 14A and 14C, an admix auger 61 as an example of a second stirring member is mounted in the second stirring chamber 48 and the replenishing chamber 52. The admix auger 61 has a rotational shaft 62 extending in the front-and-rear direction and a carry blade 63 formed on the outer periphery of the rotational shaft 62. When the admix auger 61 is rotated, the admix auger 61 carries developer in the second stirring chamber 48 in a second carry direction from the second inlet portion E2 to the first inlet portion E1 while stirring the developer.

The carry blade 63 of the admix auger 61 of the exemplary embodiment has a replenishing and carrying portion 63*a* which is disposed at the rear end, that is, the upstream end in the second carry direction and carries developer in the replenishing chamber 52 from the replenishing port 53 to the second inlet portion E2. A plate-shaped flow-in stirring portion 63*b* is disposed at the front side of the replenishing and carrying portion 63*a* so as to face the second inlet portion E2 and so as to be inclined to the rotational shaft 58, and stirs developer flowing from the second inlet portion E2. A single-spiral second main carry portion 63*c* extending to a position facing the first inlet portion E1 is disposed at the front side of the flow-in stirring portion 63*b*, and it carries the developer in the second stirring chamber 48 to the first inlet portion E1 while stirring the developer in the second stirring chamber 48. Plural plate-shaped stirring portions 63*d* which extend along the axial direction of the rotational shaft 62 and stir the developer are disposed in an area where the second main carry portion 63*c* is disposed.

A second reverse carry portion 63*e* configured by a spiral whose winding direction is opposite to that of the second main carry portion 63*c* is disposed at the front side of the second main carry portion 63*c* so as to face the first inlet portion E1. The second reverse carry portion 63*e* traps developer carried through the second stirring chamber 48 and moves the developer to the first stirring chamber 47 through the first inlet portion E1.

(Description of Driving Transmitting System of Developing Member)

In FIGS. 5, 10A, 10B, 12 and 14A, a gear shaft 65 extending to the back side is mounted at the rear end of the lower left portion of the developing housing 36. A driven gear G1 as an example of a driving transmission target member is rotatably mounted on the gear shaft 65. When the process unit UY is mounted in the image forming apparatus main body U2, the driven gear G1 is engaged with a driving gear (not shown) which is mounted in the image forming apparatus main body U2 and to which the driving force from a driving source is transmitted, whereby the driving force is transmitted to the driven gear G1. A first intermediate gear G2 and a second intermediate gear G3 as an example of an intermediate gear are rotatably disposed at the front side of the driven gear G1 so as to be concentric with the driven gear G1.

In FIG. 12, a developing roll gear G4 as an example of a gear is mounted at the rear end of the developing roll R0*y*, and the developing roll gear G4 is engaged with the first intermediate gear G2. Accordingly, when the driving force is transmitted to the driven gear G1, the developing roll gear G4 is rotated through the first intermediate gear G2, and the developing roll R0*y* is rotated. Ring-shaped tracking rolls 64 as an example of an interval setting member are rotatably mounted at both the front and rear end portions of the developing roll R0*y*, and they are configured to have a larger diameter than the outer diameter of the developing roll R0*y*.

In FIG. 14A, the rear end portion of the rotational shaft 58 of the supply auger 57 penetrates through the developing housing 36 and projects to the rear side, and a supply gear G5 as an example of a gear is mounted on the rear end of the supply auger 57. The supply gear G5 of the supply auger 57 is engaged with the second intermediate gear G3, and the developing roll R0*y* and the supply auger 57 rotate in the same rotational direction in FIG. 13.

The front end portions of the rotational shaft 58 of the supply auger 57 and the rotational shaft 62 of the admix auger 61 penetrate through the developing housing 36, and project to the front side. A front transmission gear G6 as an example of a gear is mounted at the front end of the supply auger 57. The front transmission gear G6 is engaged with a front intermediate gear G7 as an example of a gear which is rotatably mounted at the front end of the developing housing 36, and the front intermediate gear G7 is engaged with an admix gear G8 as an example of a gear which is mounted at the front end of the admix auger 61. Accordingly, when the driving force is transmitted to the driven gear G1, the supply gear G5 is rotated through the second intermediate gear G3, and the supply auger 57 is rotated. When the supply auger 57 is rotated, the rotation is transmitted to the admix auger 61 through the respective gears G6 to G8, and the admix auger 61 is also rotated. Accordingly, when the driving force is transmitted from the driven gear G1, the respective augers 57 and 61 are rotated, and developer is carried while circulated in the stirring chambers 47 and 48, and the developing roll R0*y* is rotated while holding the developer on the surface thereof.

A circulating chamber 47+48 of the exemplary embodiment is configured by the first stirring chamber 47 and the second stirring chamber 48. Furthermore, driven transmission systems G1 to G8 are configured by the respective gears G1 to G8

(Description of Members Mounted at the Outside of Developing Housing)

Figure 19A:
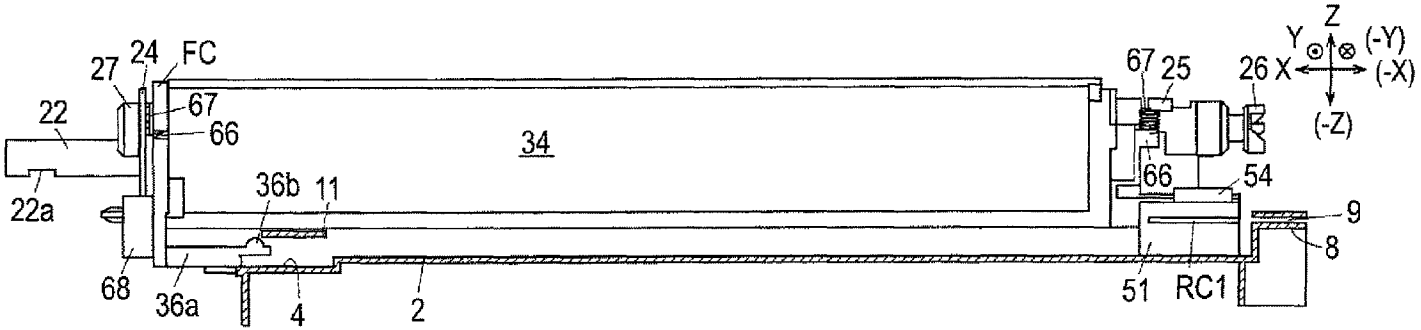
Figure 19B:
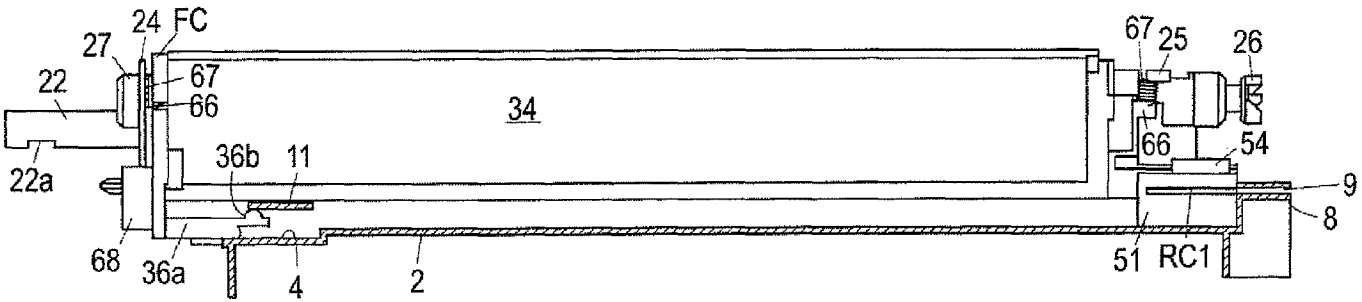
Figure 19C:
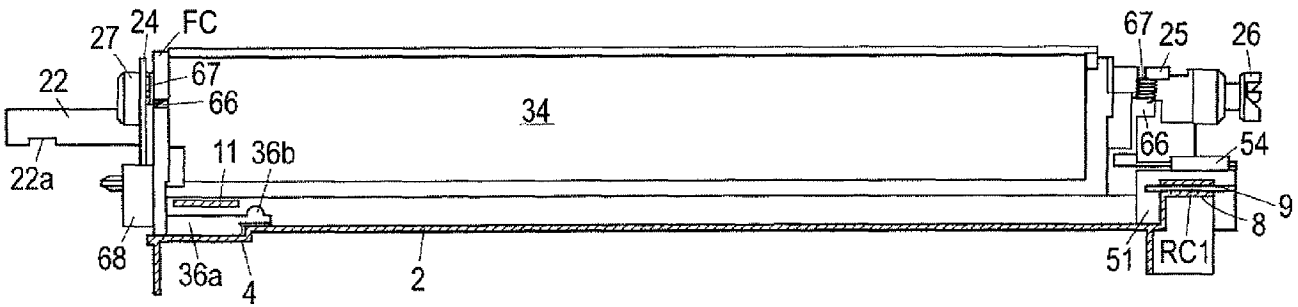

FIGS. 19A to 19*c* are diagrams showing the relationship between the identification target portion and the regulation target portion of the processing unit and the identifying unit and the regulating unit of the unit mounting portion in the exemplary embodiment. FIG. 19A is a diagram showing a state that the engagement between the regulation target portion and the regulating unit is started, FIG. 19B is a diagram showing a state that the engagement between the identifying unit and the identification target portion is started under the state that the process unit is inserted from the state shown in FIG. 19A and the regulation target portion and the regulating unit are engaged with each other, and FIG. 19C is a diagram showing a state that the mount of the processing unit is completed, so that the identifying unit and the identification target portion are engaged with each other and also the engagement between the regulation target portion and the regulating unit is released.

In FIGS. 9 to 12, a color identification key RC1 projecting to the right side as an example of an identification target portion is formed at the right side portion of the replenishing portion 51 in the rear cover RC of the exemplary embodiment. As shown in FIG. 5, the respective color identification keys RC1 are formed at different height positions in accordance with different colors so as to correspond to identification paths 9*y* to 9*k* of color identification guides 8*y* to 8*k*. In FIGS. 19A to 19C, the identification paths 9*y* to 9*k*, the backlash regulating guides 11, the backlash regulating projections 36*b* and the color identification keys RC1 are set in length and position in the front-and-rear direction so that the backlash regulating projection 36*b* at the upstream side in the mount direction is brought into contact with and fitted to the backlash regulating guide 11 before the color identification key RC1 at the downstream side in the mount direction of the process cartridge UY reaches the identification path 9*y* to 9*k* as shown in FIG. 19A, and also the backlash regulating projection 36*b* passes over the back side of the rear end of the backlash regulating guide 11 before the mount of the process cartridge UY is completed, so that the fitting between the backlash regulating projection 36*b* and the backlash regulating guide 11 is released as shown in FIG. 19C.

In FIGS. 5, 9, 11A, 11B and 12, tracking spring support portions 66 as an example of an urging member support portion are formed at the upper portions of the front cover FC and the rear cover RC so as to correspond to the tracking sprig support portions 25 of the cleaner unit 21, and a tracking spring 67 as an example of an urging member for urging the developing unit 31 to the cleaner unit 21 side is connected between the tracking spring support portions 25 and 66.

In the process unit UY of the exemplary embodiment, at the rear end portions of the photoconductor cleaner unit 21 and the developing unit 31, a joint portion 21*a* of the photoconductor cleaner unit 21 side is rotatably joined to the gear shaft 65 as shown in FIG. 10B. Furthermore, at the front end portions thereof, the front cover FC of the developing unit 31 side and a joint portion (not shown) of the photoconductor cleaner unit 21 are rotatably joined to each other, so that the developing unit 31 is swingably mounted on the photoconductor cleaner unit 21.

Accordingly, the tracking roll 64 of the developing unit 31 is pressed by urging force of the tracking spring 67, and the tracking roll 64 of the developing unit 31 is brought into contact with both the end portions of the photoconductor PRy of the photoconductor cleaner unit 21, so that the interval between the surface of the developing roll R0*y* of the developing unit 31 and the surface of the photoconductor PRy is set and kept to a predetermined interval.

In FIG. 11, A projecting protection portion 68 projecting to the front side is formed at the lower portion of the front cover FC so as to cover the front gears G6 to G8 so that the front gears G6 to G8 are not exposed to the outside. A slit-shaped first seal passing port 69 as an example of a first sealing member passing port is formed at the upper side of the projecting protection portion 68, and a slit-shaped second seal passing port 70 as an example of a second sealing member passing port is formed at the upper right side of the projecting protection portion 68.

(Description of Starter Accommodating Unit)

Figure 20:
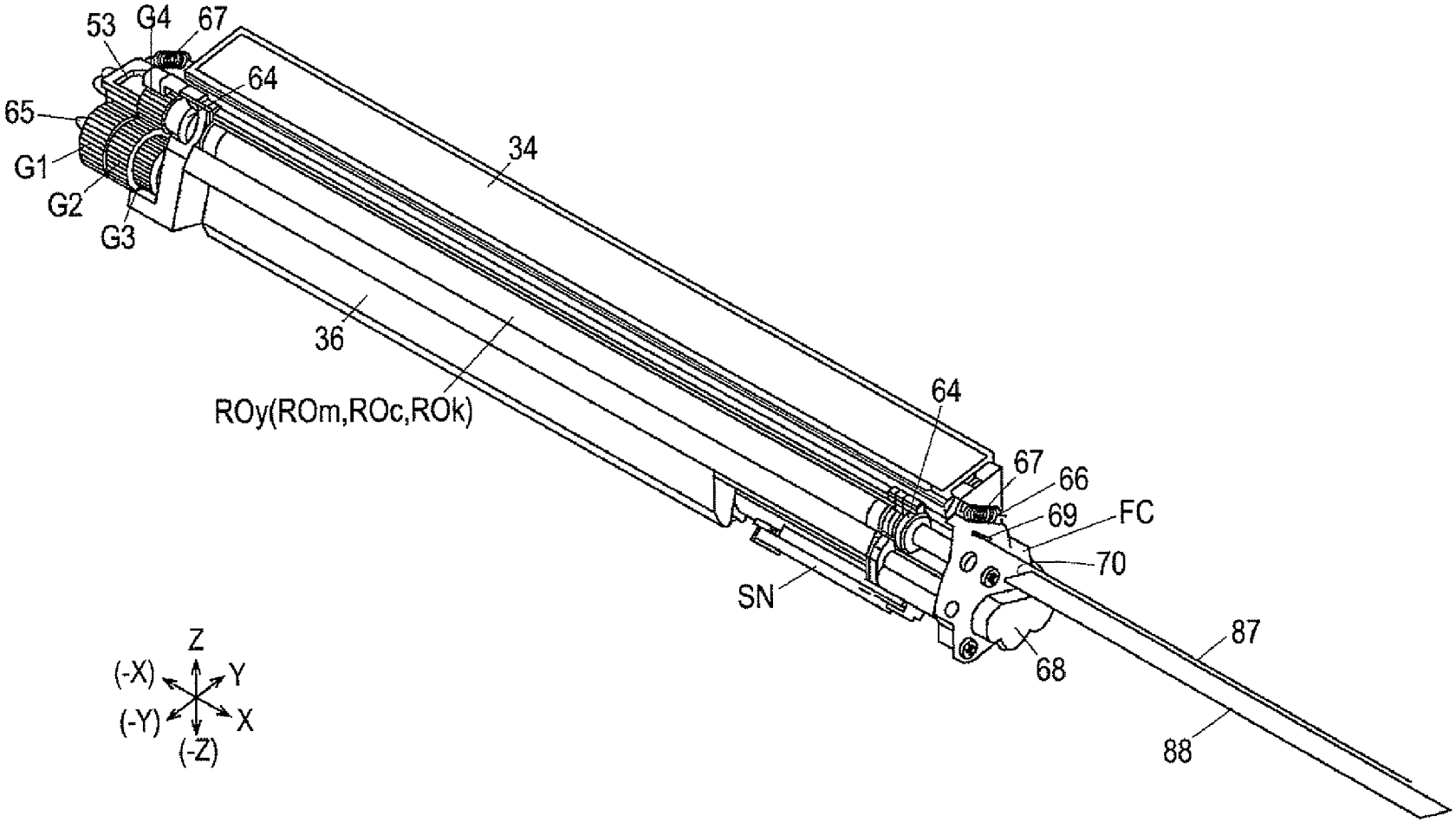
FIG. 20 is a perspective view showing a developing unit under a state that a loosening member and a sealing member are mounted in the developing unit.
Figure 21:
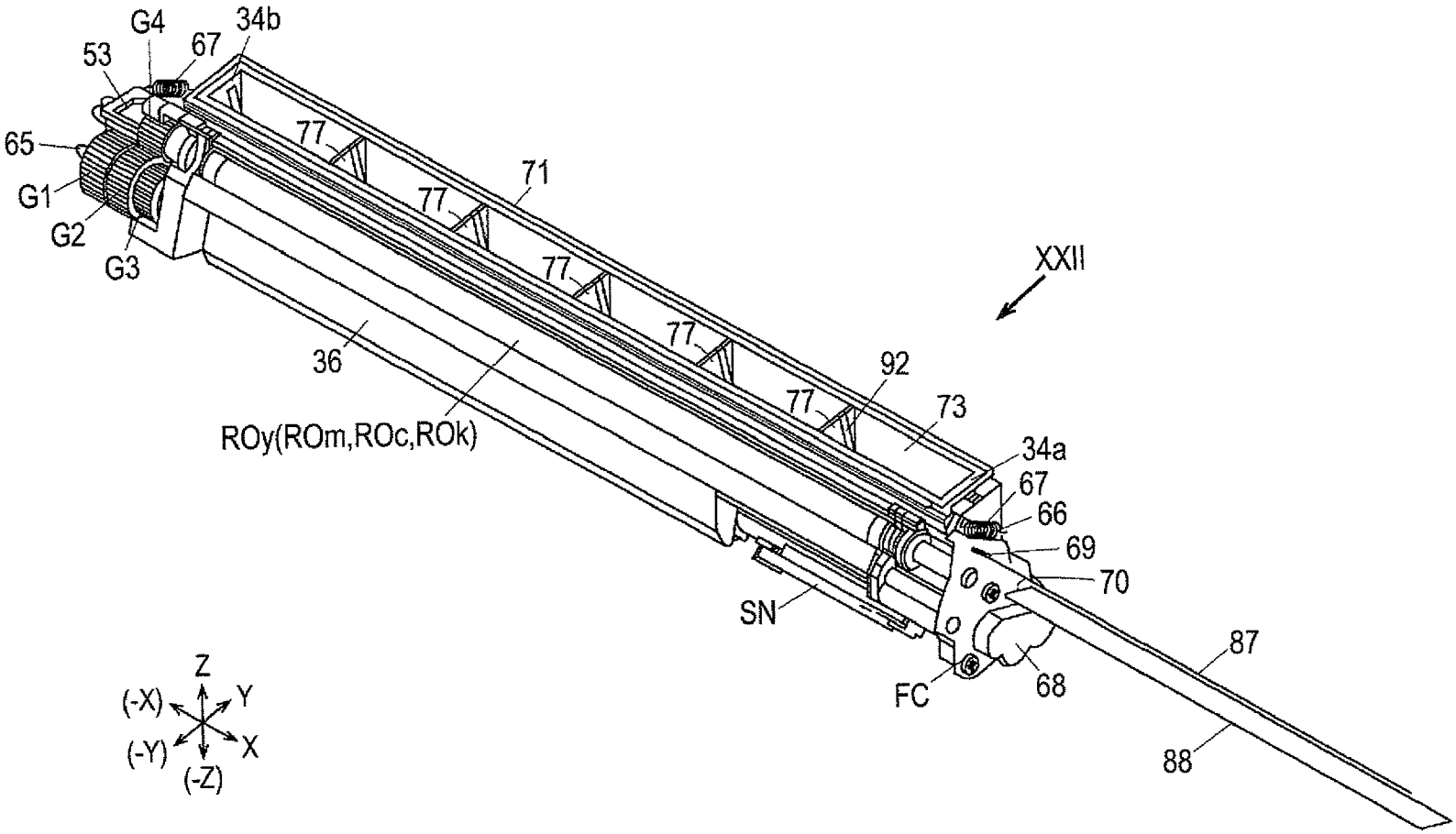
FIG. 21 is a diagram showing a state that an upper lid of a developer container is detached from the state shown in FIG. 20.
Figure 22:
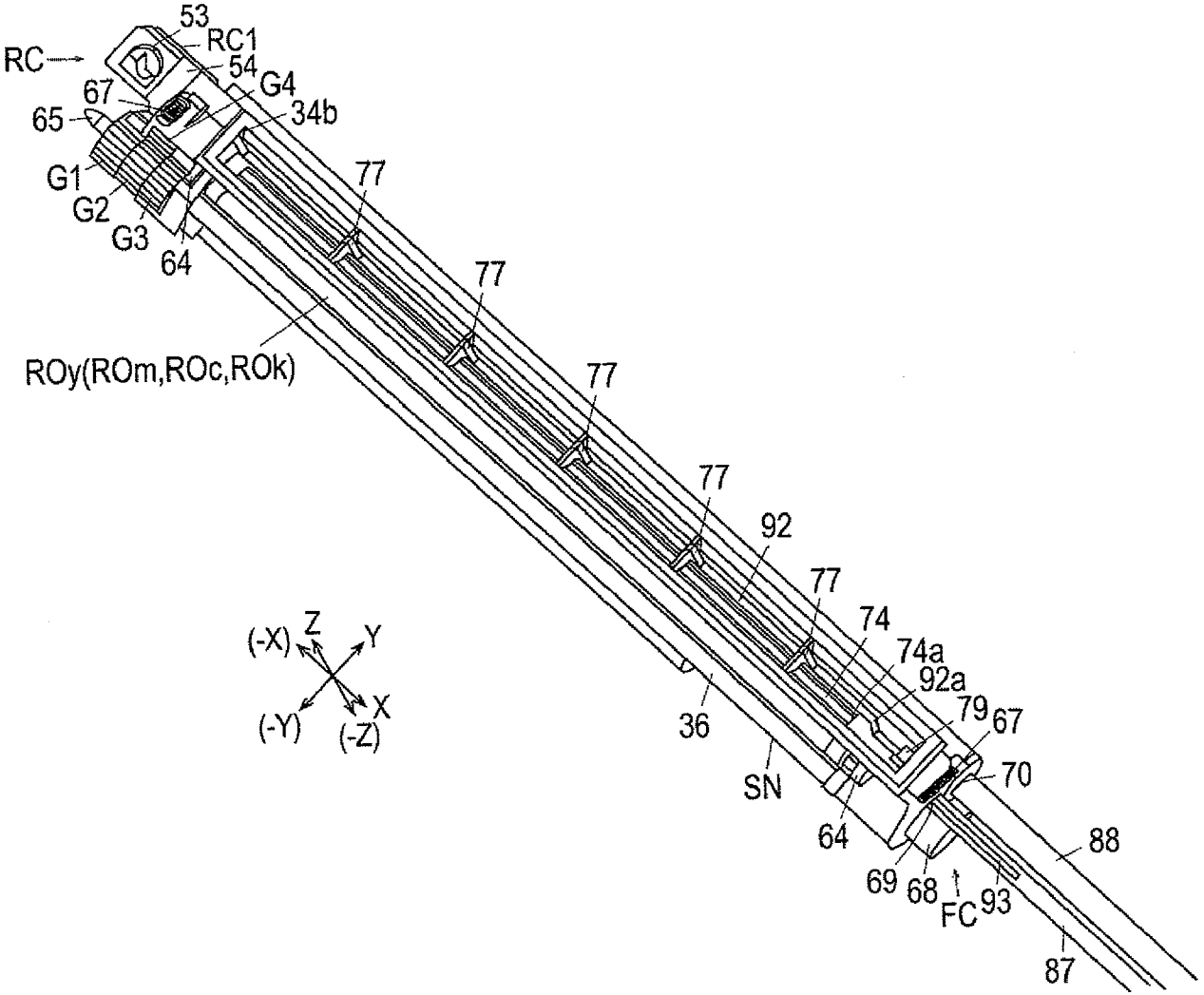
FIG. 22 is a diagram showing the state of FIG. 21 when viewed from a direction of an arrow XXII of FIG. 21.
Figure 23:
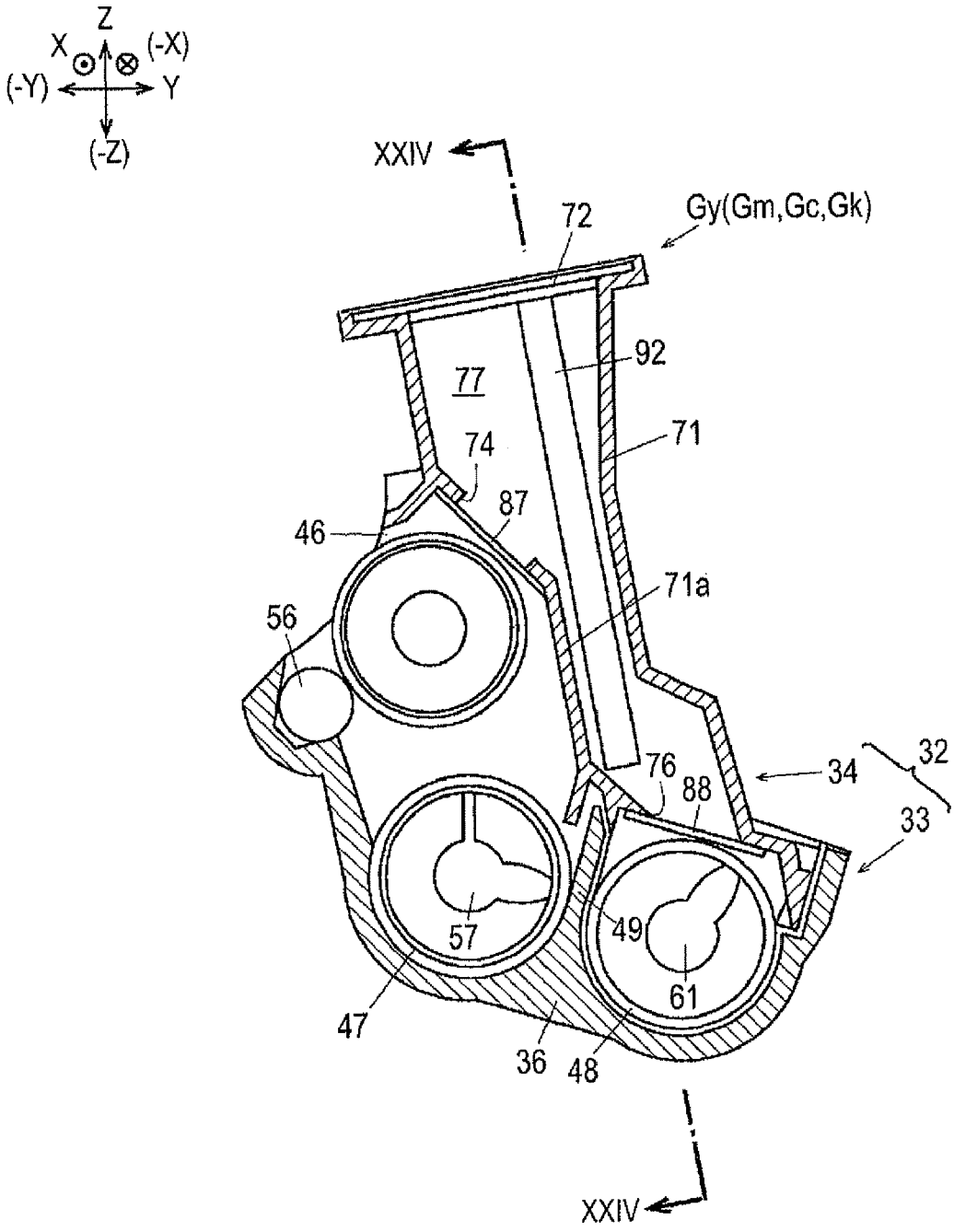
FIG. 23 is a cross-sectional view showing a main part under the state shown in FIG. 20.
Figure 24:
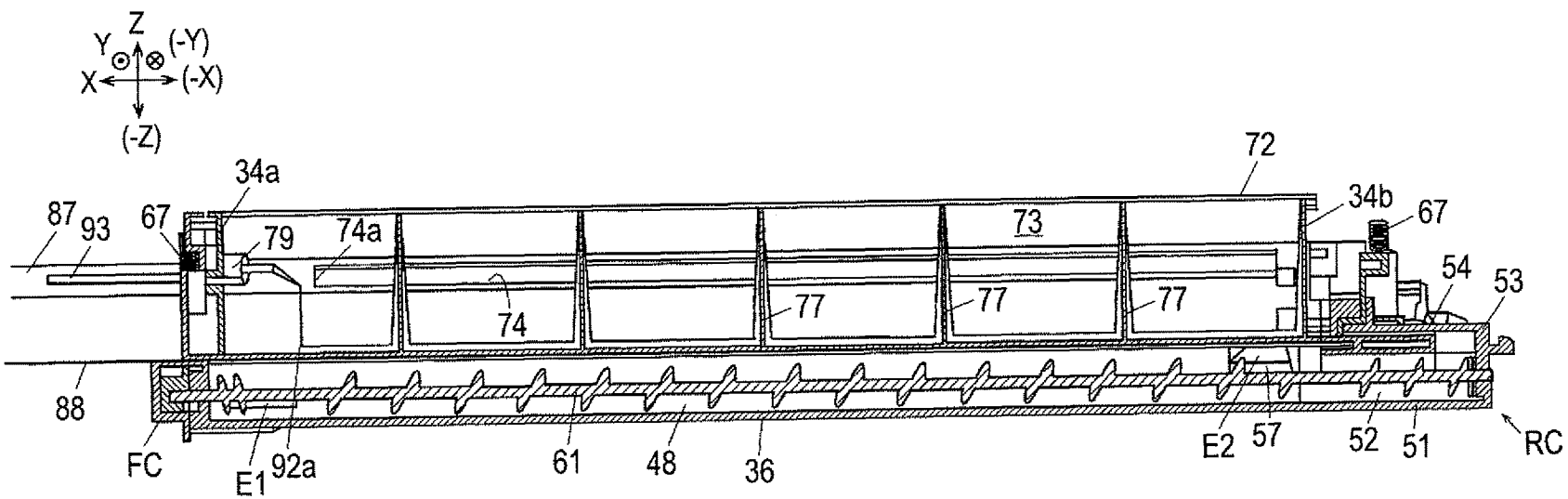
FIG. 24 is a cross-sectional view taken along a line of XXIV-XXIV of FIG. 23.

FIG. 20 is a perspective view showing the developing unit under a state that a loosening member and a sealing member are mounted in the developing unit. FIG. 21 is a diagram showing a state that an upper lid of the developer container is detached from the state shown in FIG. 20. FIG. 22 is a view taken along a direction of an arrow XXII of FIG. 21, FIG. 23 is a cross-sectional view showing a main part under the state shown in FIG. 20, and FIG. 24 is a cross-sectional view taken along XXIV-XXIV of FIG. 23.

In FIGS. 12, 13, 20 and 21, the starter accommodating unit 34 has an accommodating portion main body 71 in which developer is accommodated, and an upper lid 72 for closing the upper end of the accommodating portion main body 71. In FIG. 13 and FIGS. 22 to 24, the accommodating portion main body 71 has an inner lid 71*a* for closing the upper surface of the developing housing 36, and a starter accommodating space 73 as an example of a developer accommodating space is formed in the accommodating portion main body 71. That is, the developing roll mount chamber 46 of the developing housing 36, the respective stirring chambers 47 and 48 and the starter accommodating space 73 are compartmented by the inner lid portion 71*a*.

In FIG. 13 and FIGS. 21 to 24, the starter accommodating space 73 is configured so as to be longer in length in the front-and-rear direction and larger in width in the right-and-left direction at the upper portion thereof than the developing roll R0*y*. Furthermore, the width in the right-and-left direction of the starter accommodating space 73 is narrower as the position thereof is shifted to the lower side, and partially broader at the upper portion of the second stirring chamber 48.

Figure 25:
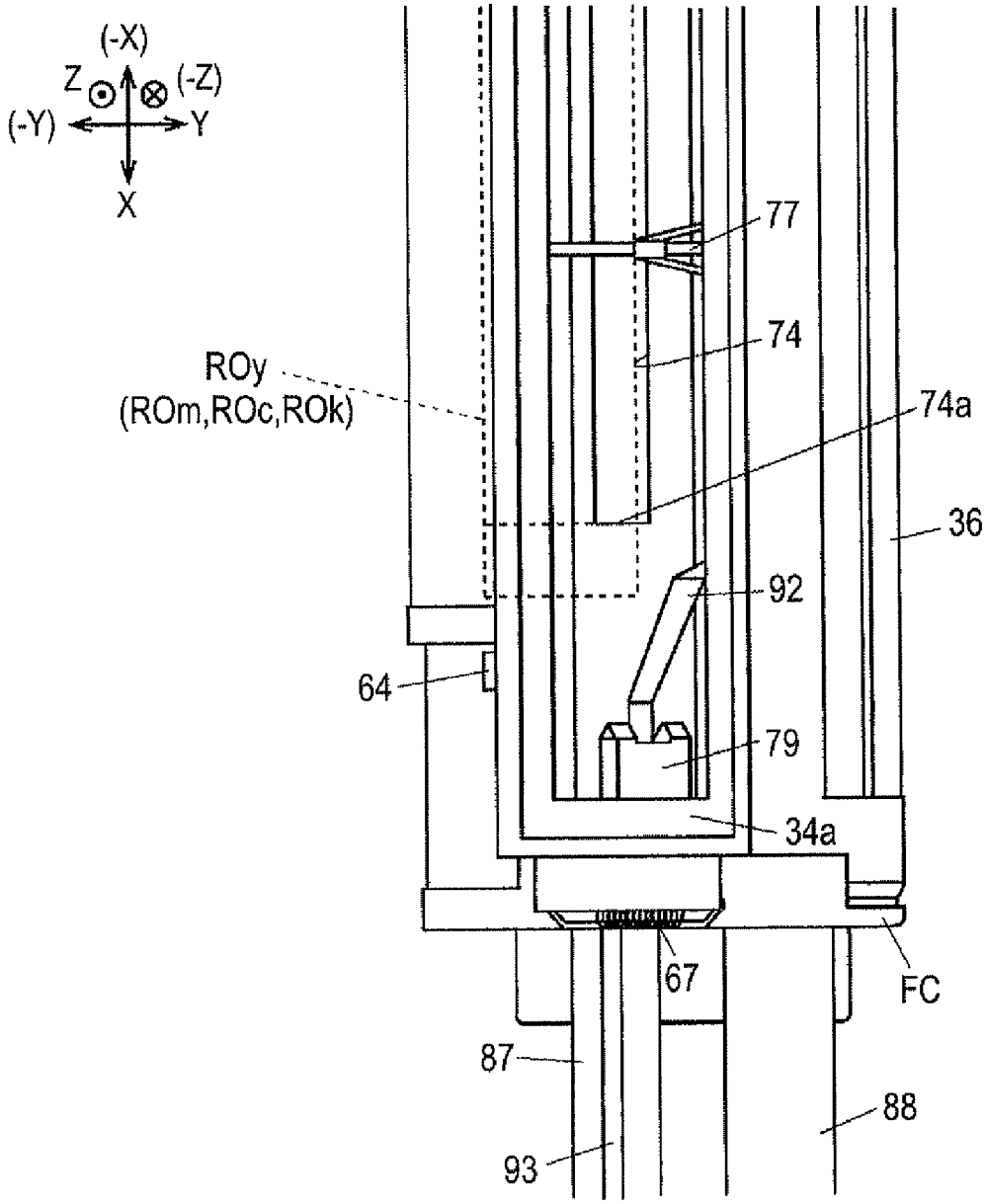
FIG. 25 is a diagram showing a main part of a inlet port of a front end of the developer container.

FIG. 25 is a diagram showing a main part of the inlet port at the front end of the developer container.

In FIGS. 13, 22 to 25, the inner lid portion 71*a* is provided with an upper inlet port 74 as an example of a first inlet port for connecting the upper portion of the starter accommodating space 73 and the developing roll mount chamber 46, and a lower inlet port 76 as an example of a second inlet port for connecting the lower end portion of the starter accommodating space 73 and the second stirring chamber 48. In FIG. 25, the upper inlet port 74 of the exemplary embodiment is formed along the front-and-rear direction, and the front end of the upper inlet port 74 is formed so as to correspond to the position of the front end of the developing roll R0*y*. Accordingly, the front end 74*a* of the upper inlet port 74 does not reach the front end wall 34*a* of the starter accommodating unit 34, and a gap is formed between the front end 74*a* of the upper inlet port 74 and the front end wall 34*a*. The lower inlet port 76 of the exemplary embodiment is formed so as to correspond to the whole length in the front-and-rear direction of the starter accommodating unit 34.

In FIGS. 13, 22 to 25, plural wall type partition ribs 77 for partitioning the starter accommodating space 73 as an example of a partition member are disposed in the starter accommodating unit 34 so as to be spaced from one another at a preset interval in the front-and-rear direction. The partition ribs 77 of the exemplary embodiment are configured so that the height of the upper ends thereof correspond to the height of the upper end of the starter accommodating space 73 and also is set to be slightly lower than the upper end of the starter accommodating space 73. Accordingly, under the state that the starter accommodating space 73 is covered by the upper lid 72, a gap is formed between the lower surface of the upper lid 72 and the upper end of each of the partition ribs 77. Accordingly, the upper ends of the partition ribs 77 of the exemplary embodiment are disposed to be higher than the upper inlet port 74.

Figures 26A, 26B, 26C:
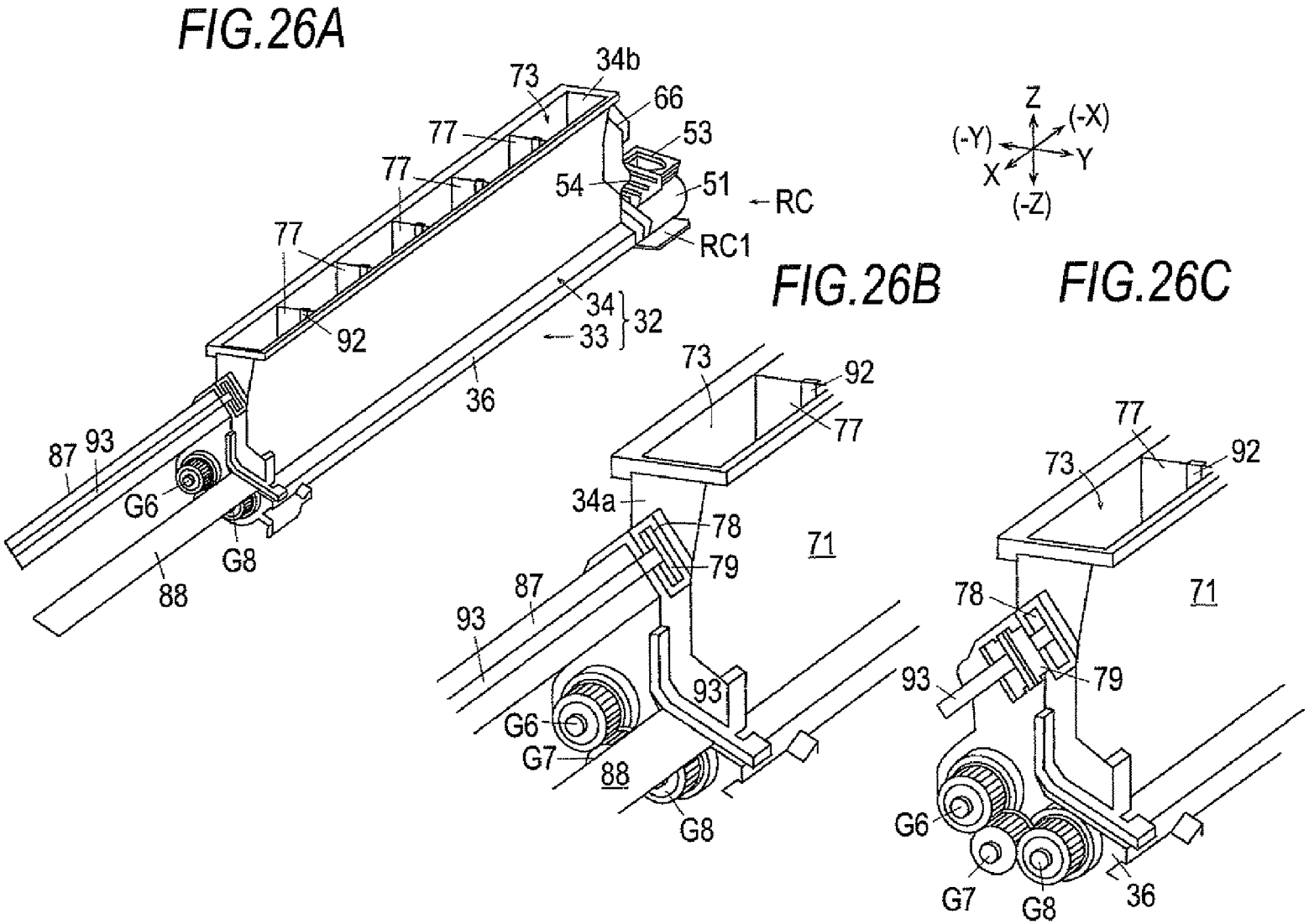
Figure 27A:
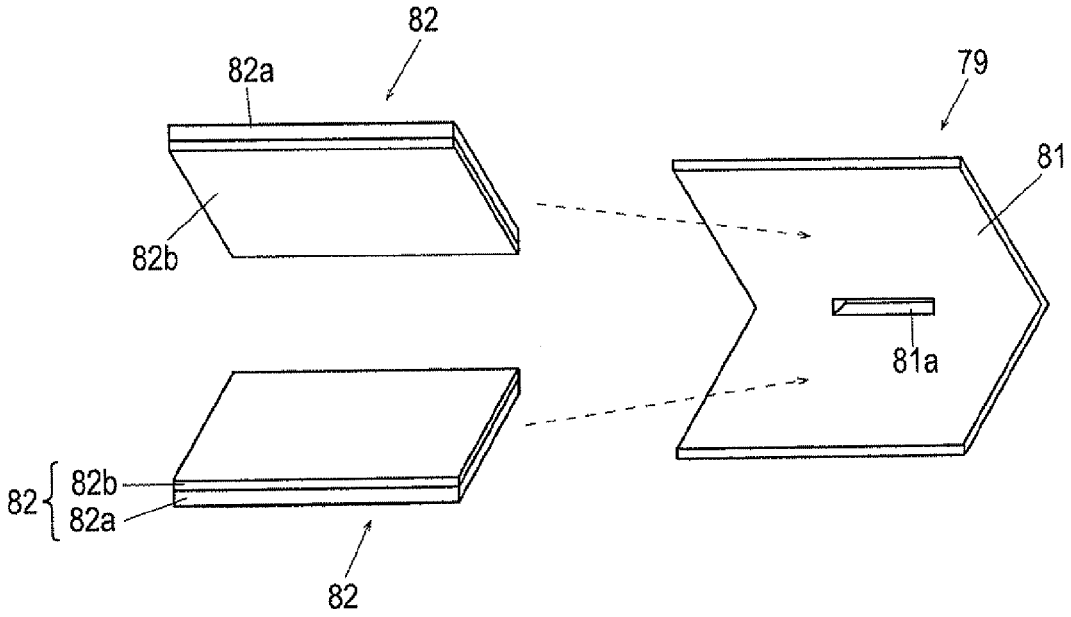
Figure 27B:
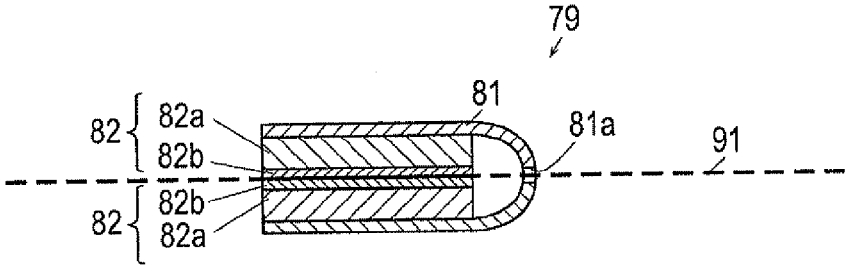

FIGS. 26A to 26C are diagrams showing the front end portion of the developer, container, wherein FIG. 26A is a diagram showing the overall construction of the front end portion, FIG. 26B is an enlarged view of a main part of the front end portion, and FIG. 26C is a diagram showing a state that a contact member is detached from the front end portion. FIGS. 27A and 27B are diagrams showing the contact member, wherein FIG. 27A is an exploded view showing the contact member, and FIG. 27B is a cross-sectional view of a main part of the contact member.

In FIG. 26, a loosening drawing port 78 penetrating in the front-and-rear direction is formed at the upper portion of the front end wall 34*a* of the starter accommodating unit 34 of the exemplary embodiment so as to be disposed at the position corresponding to the obliquely upper left side of the upper inlet port 74. A drop seal 79 as an example of a contact member is mounted at the loosening drawing port 78.

In FIG. 26C and FIGS. 27A and 27B, the drop seal 79 has a thin-film type seal base 81. As shown in FIG. 27B, the seal base 81 is designed like thin film so as to be folded in U-shape under the state that the drop seal 79 is mounted at the loosening drawing port 78, and a guide port 81*a* as an example of a loosening guide port is formed at the center portion of the seal base 81. A resin material which is elastically deformable and has an outer surface having a low friction coefficient is used for the seal base 81 of the exemplary embodiment so that it can be smoothly mounted at the loosening drawing port 78. For example, it may be formed of polyethylene terephthalate, so-called PET resin.

In FIGS. 26A to 26C and 27A and 27B, a pair of contact member main bodies 82 are mounted on the inner surface of the seal base 81 so as to be located at both the sides of the guide port 81*a*. The contact member main bodies 82 has a cushion portion 82*a* (as an example of pressure applying portion) formed of polyurethane as an example of an elastic material mounted on the seal base 81. A cleaner portion 82*b* formed of felt as an example of cloth is mounted as an example of a cleaning portion on the surface of the cushion portion 82*a*. In the contact member main body 82 of the exemplary embodiment, the total thickness of the pair of cushion portions 82*a* and the cleaner portions 82*b* is set to be larger than the width of the loosening drawing port 78. That is, the total thickness concerned is set so that the cushion portion 82*a* is mainly elastically deformed and the cleaner portions 82*b* are kept to come into contact with each other under a preset contact pressure when the drop seal 79 is mounted at the loosening drawing port 78. Accordingly, when the cleaner portions 82*b* are held in close contact with each other, the loosening drawing port 78 is hermetically sealed by the drop seal 79, and developer can be prevented from leaking from the starter accommodating unit 34.

(Description of Sealing Member)

In FIG. 20 to FIG. 26C, the sealing member 86 and the loosening member 91 are mounted in the process unit UY before the process unit UY is used, for example, under such a state that an image forming apparatus U before shipping or a process unit UY for exchange before shipping is stored. In FIG. 23, the sealing member 86 of the exemplary embodiment has an upper heat seal 87 as an example of a first sealing member for closing the upper inlet port 74 and a lower heat seal 88 as an example of a second sealing member for closing the lower inlet port 76, and developer having a preset toner density is accommodated and enclosed in the starter accommodating space 73 which is hermetically sealed by the respective heat seals 87 and 88. Each of the heat seals 87 and 88 of the exemplary embodiment is formed of belt type thin film, so-called film which is larger in width and longer in the front-and-rear direction than the respective inlet ports 74 and 76.

Figure 28A:
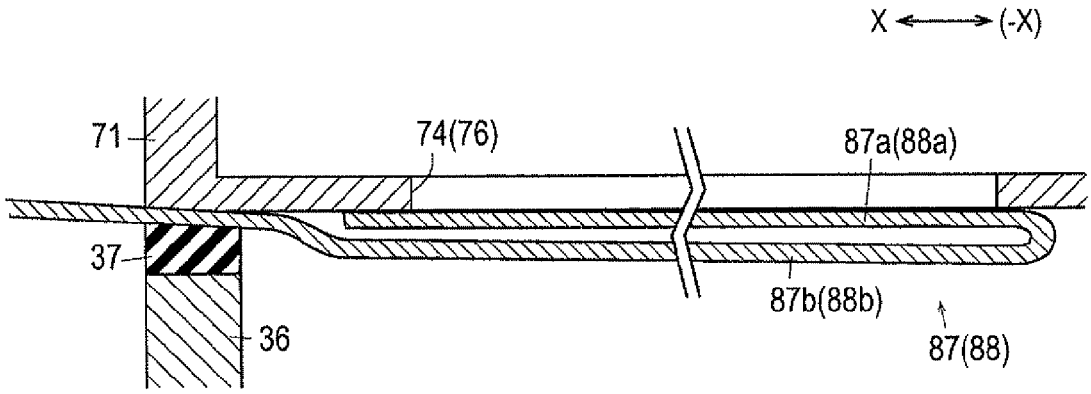
Figure 28B:
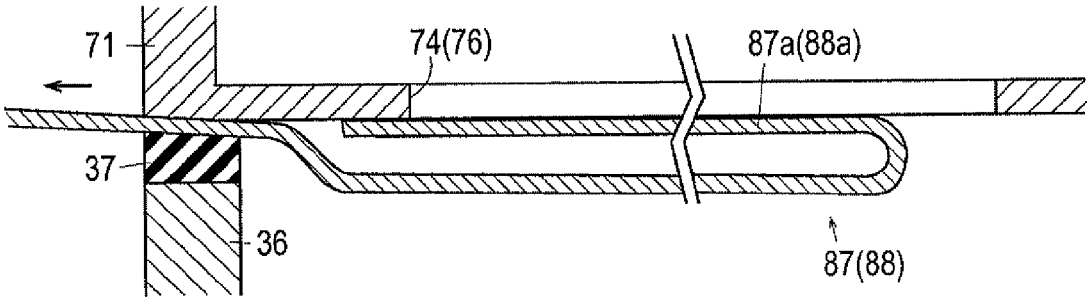
Figure 28C:
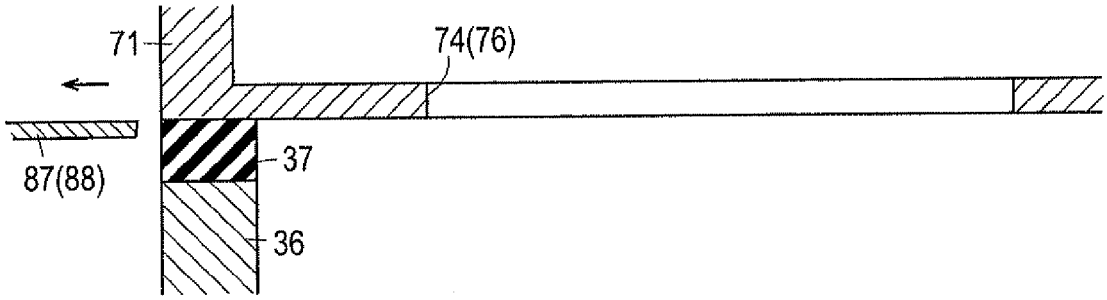

FIGS. 28A to 28C are diagrams showing the sealing member according to the exemplary embodiment, wherein FIG. 28A shows a state before the sealing member is detached, FIG. 28B shows a state that the sealing member is being detached, and FIG. 28C shows a state after the sealing member is detached.

In FIGS. 28A to 28C, each of the heat seals 87 and 88 of the exemplary embodiment has a sealing portion 87*a*, 88*a* mounted at the edge of each inlet port 74, 76 of the lower surface of the inner lid portion 71*a*, and a return portion 87*b*, 88*b* which returns from the rear end portion of the sealing portion 87*a*, 88*a* and extends to the front side. The sealing portion 87*a*, 88*a* of the heat seal 87, 88 is attached to the lower surface of the inner lid portion 71*a* by thermal fusion bonding under a state that the sealing portion 87*a*, 88*a* can be exfoliated from the lower surface of the inner lid portion 71*a*. A method of mounting the sealing portions 87*a* 88*a* onto the inner lid portion 71*a* is not limited to thermal fusion bonding, and any method may be adopted. For example, well-known adhesive agent, double-sided tape or the like may be adopted.

The front portion of each of the return portions 87*b*, 88*b* extends to the front side from the gap between the joint portions of the developing housing seal 37 of the developing housing 36 and the starter accommodating unit 34, and it is led out to the front side of the process unit UY through the seal passing port 69, 70 of the front cover FC.

(Description of Loosening Member)

FIGS. 29A to 29E are diagrams showing a method of fixing the loosening member and the developer container, wherein FIG. 29A is a diagram showing the fixing method of the exemplary embodiment, FIG. 29B is a diagram showing a fixing method of a first modification of the exemplary embodiment, FIG. 29C is a diagram showing a fixing method of a second modification of the exemplary embodiment, FIG. 29D is a diagram showing a fixing method of a third modification of the exemplary embodiment, and FIG. 29E is a diagram showing a fixing method of a fourth modification of the exemplary embodiment.

In FIGS. 22 to 27B, the loosening member 91 has a loosening portion 92 disposed in the starter accommodating space 73, and a drawing portion 93 extending from the front end of the loosening portion 92 to the front side. In FIG. 29A, the rear end of the loosening portion 92 is attached to the upper end of the inner surface of the rear end wall 34*b* of the starter accommodating unit 34 through a double-sided tape 94 so that the rear end of the loosening portion 92 can be exfoliated. The rear end of the loosening portion 92 adheres to the upper portion of the front surface 94*a* of the double-sided tape 94 of the exemplary embodiment, and a resin film 96 as an example of an exfoliation preventing member adheres to the lower portion of the front surface 94*a*. The resin film 96 may be formed of polyethylene terephthalate: PET or the like, for example, and the adhesion between the loosening portion 92 and the double-sided tape 94 is prevented by the resin film 96 under the state that the loosening portion 92 adheres to the double-sided tape 94, and the adhesion area between the loosening portion 92 and the double-sided tape 94, that is, the contact area is set to be smaller than the contact area between the double-sided tape 94 and the rear end wall 34*b*. Accordingly, when the rear end of the loosening member 91 is exfoliated, the double-sided tape 94 is suppressed from being exfoliated from the rear end wall 34*b* and thus drawn out together with the loosening member 91.

In FIGS. 29A to 29E, any other method may be adopted to prevent the double-sided tape 94 from being exfoliated from the rear end wall when the rear end of the loosening member 91 is exfoliated. For example, the rear end of the loosening portion 92 may be bent as shown in FIG. 29B so that the rear end of the loosening portion 92 does not come into contact with the double-sided tape 94, or the surface of the rear end wall 34*b* to which the double-sided tape 94 adheres may be subjected to rough surface processing to enhance the adhesion between the double-sided tape 94 and the rear end wall 34*b*. As another method, as shown in FIG. 29D, the adhesibility of adhesive agent of the double-side tape 94 may be varied so that the adhesibility at the rear end wall 34*b* side of the double-sided tape 94 is made stronger than that of the loosening portion 92 side of the double-sided tape 94, whereby the double-side tape 94 is hardly exfoliated from the rear end wall 34*b*. Furthermore, as shown in FIG. 29E, the rear end of the loosening portion 92 may be pinched and held by the starter accommodating unit 34 and the upper lid 72.

In FIG. 24, the loosening portion 92 extends downwardly from the rear end attached to the rear end wall 34*b* along the rear end wall 34*b*, and extends to the front side along the bottom portion of the starter accommodating unit 34 in the neighborhood of the lower inlet port 76 as shown in FIG. 23. As shown in FIGS. 22 and 24, the loosening portion 92 extends upwardly along one side surface, that is, the back surface of the partition rib 77 at the front side of the rear end wall 34*b*, crosses over the upper end of the partition rib 77, is folded back downwardly, and then extends along the other side surface, that is, the front surface of the partition rib 77 to the bottom portion of the starter accommodating unit 34. Likewise, the loosening portion 92 extends to the front end portion of the starter accommodating unit 34 along the front surface and the rear surface of each of the other partition ribs 77.

As sown in FIG. 23, the width in the right-and-left direction of the loosening portion 92 of the exemplary embodiment is set so as to correspond to the width of a narrow portion of the starter accommodating space 73 so that the loosening portion 92 can pass through the narrow portion of the starter accommodating space 73 and reach the neighborhood of the lower inlet port 76 at the lower side.

In FIGS. 24 and 25, the front portion of the loosening portion 92 of the exemplary embodiment crosses over the up-front partition rib 77 forwardly, extends to the front side along the starter accommodating space 73, and then is upwardly folded at an upward folding position 92*a* before it reaches the front end wall 34*a*. The upward folding position 92*a* is set to a position between the front end wall 34*a* and the front end of the upper inlet port 74. The loosening portion 92 which is upwardly folded at the upward folding position 92*a* is bent forwardly at the height corresponding to the loosening drawing port 78. Accordingly, the front end portion of the loosening portion 92 is not disposed along the front end wall 34*a* and the bottom portion of the starter accommodating unit 34, but disposed under a so-called slacking state.

In FIGS. 24 and 27B, the drawing portion 93 which is formed continuously with the front end of the loosening portion 92 passes through the guide port 81*a* of the drop seal 79 mounted at the loosening drawing port 78, and extends to the front side while sandwiched by the cleaner portions 82*b*. At this time, the drawing portion 93 is pinched under preset urging force from both the sides by the cushion portions 82*a*.

In FIGS. 22, 24 and 26, the loosening member 91 is adhesively connected to the upper heat seal 87 at the front end portion of the loosening drawing port 78, and led out to the front side through the first seal passing port 69. Accordingly, the upper heat seal 87 and the loosening member 91 can be drawn out integrally with each other.

(Action of Exemplary Embodiment)

According to the thus-constructed copying machine U of the exemplary embodiment, in the process units UY to UK which are detachably mounted in the image forming apparatus main body U2, rotation is transmitted to the photoconductors PRy to PRk through the couplings 26 when an image forming operation is executed, and rotation is transmitted to the developing rolls R0*y* to R0*k* through the driven gears G1. At this time, in the exemplary embodiment, the gears G1 to G8 are rotated when the developing rolls R0*y* to R0*k* are driven, and occurrence of large vibration in the developing housing 36 is unavoidable as compared with the case where the driving force is transmitted through the coupling 26. When vibration occurs, the developing housing 36 is vibrated relatively to the unit supporting portion 2, and thus the CRUM adaptor 42 which is in contact with the leaf-spring type connector terminal 14 of the main-body side connector 13 under a state that elastic force acts on the CRUM adaptor 42 is vibrated relatively to the main-body side connector 13.

Here, in a conventional configuration having no CRUM adaptor 42, the connection terminal 41*b* of CRUM 41 is kept in direct contact with the main-body side connector 13, and when vibration acts on the developing housing 36 under this state, the connector terminal 14 of the main-body side connector 13 scratches the connection terminal 41*b* of CRUM 41. Accordingly, the connection terminal 41*b* which is relatively easily exfoliated from the board 41*a* of epoxy resin may be scratched and exfoliated by the connector terminal 14, or foreign material may adhere to the exfoliated portion, and thus oxidize or deteriorate the exfoliated portion. Therefore, there is a risk that contact failure occurs with time lapse. In order to avoid this risk, the configuration of CRUM 41 may be changed so that the connection terminal 41*b* is hardly exfoliated from the board 41*a*. However, it is difficult to share the parts of CRUM 41 with other types of image forming apparatuses, so that the manufacturing cost rises. Furthermore, the connector terminal 14 is not provided, and a connector structure that a male type terminal and a female type terminal are engaged with each other, that is, a so-called drawer connector may be adopted. However, when the drawer connector is adopted, the terminal portion requires a space in which a relatively large drawer connector is disposed, and thus the overall configuration of the copying machine U grows in size.

On the other hand, according to the exemplary embodiment, the CRUM adaptor 42 is mounted between CRUM 41 and the main-body side connector 13, and CRUM 41 and the CRUM adaptor 42 are mounted integrally with the developing housing 36, that is, so as to be immovable relatively to the developing housing 36. Accordingly, even when the developing housing 36 is vibrated, CRUM 41 and the CRUM adaptor 42 are not relatively vibrated, and thus no friction occurs between the connection terminal 41*b* of CRUM 41 and the CRUM connection terminal 43*a* of the CRUM adaptor 42. Accordingly, the exfoliation of the connection terminal 41*b* is suppressed, and thus contact failure, conduction failure, transmission/reception failure of signals, etc. are suppressed.

The main-body connection terminal 43*b* of the CRUM adaptor 42 is formed of phosphor bronze from which gold-plating is hardly exfoliated. Therefore, even when vibration of the developing housing 36 occurs, gold-plating is hardly exfoliated, and conduction failure, oxidation or corrosion of phosphor bronze, etc. are suppressed. Particularly, in the exemplary embodiment, the gold plating of the main-body connection terminal 43*b* is larger in thickness than the connection terminal 41*b* of CRUM 41, and thus the resistance to exfoliation of gold is higher with time lapse as the thickness thereof is larger.

Furthermore, in the exemplary embodiment, CRUM 41 and the CRUM adaptor 42 are configured not to move relatively to each other, and even when the contact pressure between CRUM 41 and the CRUM adaptor 42 is set to be smaller than that between portions which are to be detached from each other like the CRUM adaptor 42 and the connector terminal 14, they can be surely brought into contact with each other. Accordingly, as compared with a case where the CRUM adaptor 42 is not provided, it is unnecessary to needlessly increase the contact force between CRUM 41 and the CRUM adaptor 42, and the exfoliation of the connection terminals 41*b* of CRUM 41 can be further suppressed.

According to the image forming process, information concerning operation times of the photoconductors PRy to PRk, the developing rolls R0*y* to R0*k*, etc., which is stored in CRUM 41, is updated, and time-lapse deterioration of rotating parts such as the photoconductors PRy to PRk, the developing rolls R0*y* to R0*k*, etc. and time-lapse deterioration of developer in the developing housing 33, that is, the lifetime of each of the process cartridges UY to UK is determined on the basis of the stored information at a preset timing. When each of the process cartridges UY to UK reaches the end of the lifetime thereof or breaking of a part is detected, the corresponding process cartridge UY to UK is removed, and it is exchanged by a new process cartridge UY to UK.

In the new process cartridge UY to UK, the photoconductor (PRy to PRk) side of the developing roll mount chamber 46 of the developing housing 36 is opened, and thus when developer is accommodated in the developing roll mount chamber 46 or the like, the developer may leak from the developing roll mount chamber 46 or the like under transport or under work. Accordingly, a configuration that developer is accommodated in the starter accommodating unit 34 which is hermetically sealed by the heat seals 87 and 88 has been hitherto broadly adopted for process cartridges UY to UK under storage or under transport. A worker pulls out the heat seals 87, 88 immediately before the process cartridges UY to UK are mounted in the image forming apparatus main body U2, whereby developer is made to flow from the starter accommodating unit 34 into the developing roll mount chamber 46 and the stirring chambers 47, 48 so that the developer can be used.

At this time, when the process cartridges UY to UK are stored for a long term or vibration acts on the process cartridges UY to UK under transport, there is a risk that the developer is pressed and packed by its own weight and thus the developer is agglomerated. A conventional configuration that the loosening member 91 is not provided has a risk that the agglomerated developer flows into the developing housing 36 and is used for development before it is sufficiently flaked, so that developing failure or the like may occur. Particularly when the agglomerate of developer becomes enlarged, it does not pass through each of the inlet ports 74 and 76 and thus remains in the starter accommodating unit 34, so that the developer is wasted without being used. Furthermore, there is a risk that the developer remaining in the starter accommodating unit 34 drops to the developing roll mount chamber 46 due to vibration under an image forming operation and is used for development before it is sufficiently flaked.

Figure 30A:
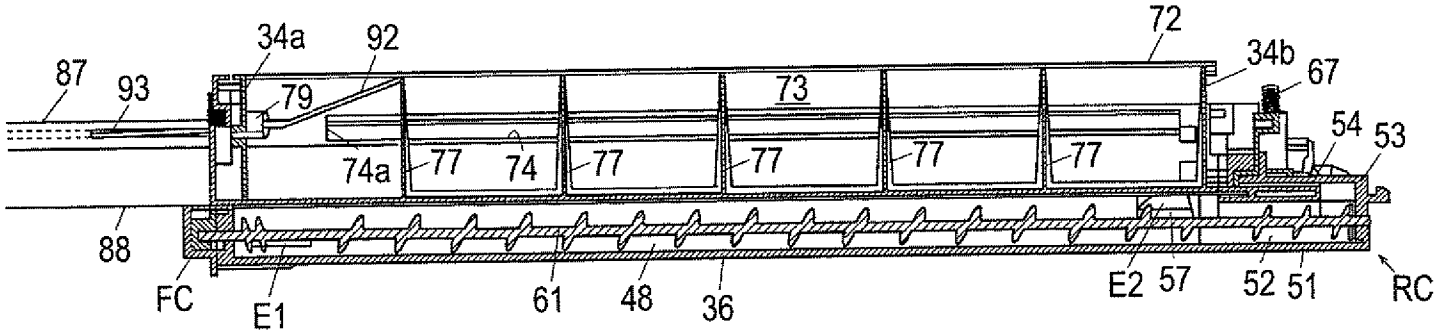
Figure 30B:
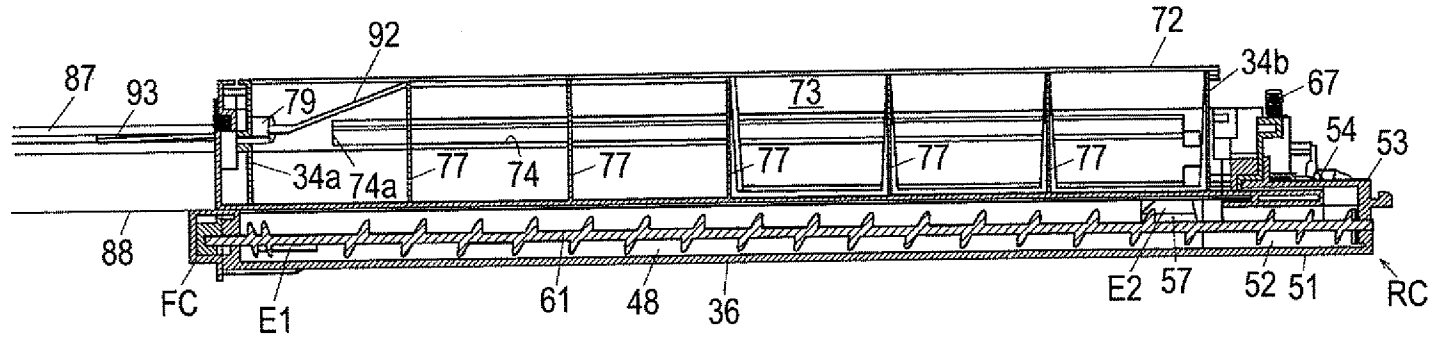
Figure 30C:
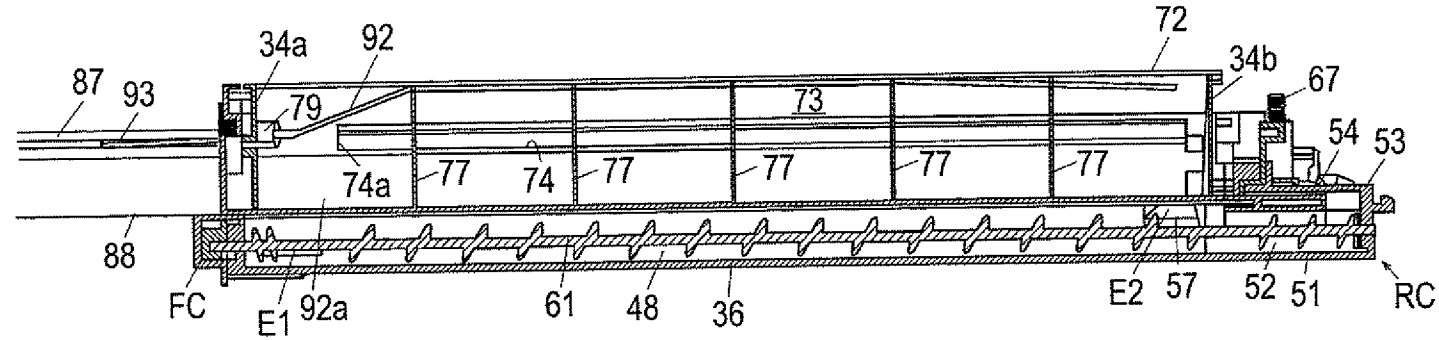

FIGS. 30A to 30C are diagrams showing the process of drawing out the loosening member in the exemplary embodiment, wherein FIG. 30A shows a state that the loosening member is drawn out to the front side from the state shown in FIG. 24, FIG. 30B shows a state that the loosening member is further drawn out to the front side from the state shown in FIG. 30A, and FIG. 30C shows a state that the loosening member is further drawn out to the front side from the state shown in FIG. 30B.

In FIG. 24 and FIGS. 30A to 30C, with respect to the process cartridges UY to UK of the exemplary embodiment, the loosening member 91 is mounted in the starter accommodating unit 34. When the loosening member 91 disposed along the bottom surface of the starter accommodating space 73 and both the front and rear surfaces of the partition ribs 77 is drawn out to the front side, as shown in FIGS. 30A to 30C, the loosening portion 92 along the bottom surface and the front surface of the partition rib 77 is drawn up to the positions corresponding to the upper ends of the partition ribs 77, so that the developer in the starter accommodating space 73 is loosend. Accordingly, in the starter accommodating space 73, the loosening portion 92 which is disposed in zigzags along the bottom surface and the surfaces of the partition ribs 77 is drawn out to the front side with being tensed. When the loosening portion 92 is further drawn out from the state that the loosening portion 92 is tensed between the front end thereof and the rear end wall 34*b*, the rear end of the loosening portion 92 is separated from the double-sided tape 94 and drawn out to the front side as shown in FIG. 30C.

Accordingly, in the process cartridges UY to UK of the exemplary embodiment, when the loosening member 91 is drawn out, the developer in the starter accommodating space 73 is loosend, and the loosend developer flows from the respective inlet ports 74, 76 into the developing housing 36. Accordingly, as compared with the conventional configuration that the loosening member 91 is not provided, the agglomerated developer is more greatly suppressed from being supplied to the developing housing 36 and remaining in the starter accommodating unit 34, so that the developing failure is suppressed.

Furthermore, in the exemplary embodiment, the partition ribs 77 are provided in the starter accommodating unit 34 so that the inside of the starter accommodating unit 34 is partitioned into plural chambers by the partition ribs 77. Furthermore, the loosening member 91 is disposed along the partition ribs 77, and when the loosening member 91 is drawn out, the loosening portion 92 is lifted up to the upper end of each partition rib 77 in each partitioned chamber. Accordingly, the loosening portion 92 is also extracted out in the front-and-rear direction corresponding to the draw-out direction. Accordingly, as compared with a configuration that developer is hardly loosend, the loosening portion 92 is more easily movable in the up-and-down direction intersecting to the drawing direction in the starter accommodating unit 34 and thus the developer is more easily loosend. Particularly, in the exemplary embodiment, the height of the partition ribs 77 is set to be higher than the loosening drawing port 78, and thus the loosening portion 92 is surely moved from a position lower than the loosening drawing port 78 to a position higher than the loosening drawing port 78. Therefore, the loosening capability is enhanced as compared with a case where the height of the partition ribs 77 is lower than the loosening drawing port 78.

Furthermore, the loosening portion 92 loosens the developer in each chamber partitioned by the partition ribs 77 in the process of drawing out the loosening member 91. Therefore, as compared with a case where the partition ribs 77 are not provided and all the developer in the starter accommodating space 73 is loosend in a lump, the force and load required for the worker to drawn out the loosening member 91 may be reduced.

Still furthermore, in the exemplary embodiment, the height of the partition ribs 77 is set to be higher than the upper inlet port 74, and the loosening portion 92 is moved to a higher position than the upper inlet port 74 to loosen the developer. Accordingly, non-loosend developer is suppressed from flowing into the upper inlet port 74.

In the exemplary embodiment, when agglomerate of developer occurs, the developer is liable to clog at a narrow portion of the starter accommodating space 73 at the upper side of the lower inlet port 76. However, in the loosening member 91 of the exemplary embodiment, the width of the loosening portion 92 is set so that the loosening portion 92 can pass through the narrow portion of the starter accommodating space 73. Accordingly, the loosening member 91 passes through the narrow portion and then extends to the bottom portion at the lower side. Accordingly, when the loosening portion 92 is moved, it passes over a position at which developer is more liable to clog, and clogging of the developer can be more greatly reduced as compared with a case where the loosening portion 92 is disposed at only the upper portion of the starter accommodating space 73.

Furthermore, in the exemplary embodiment, the loosening member 91 is connected to the upper heat seal 87, and when the upper heat seal 87 is drawn out to the front side, the loosening member 91 is integrally drawn out. Accordingly, the working frequency of the worker can be reduced as compared with a configuration that the upper heat seal 87 and the loosening member 91 are drawn out separately from each other.

In this case, with respect to the loosening member 91 of the exemplary embodiment, the front end portion of the loosening portion 92 is disposed in the starter accommodating space 73 so that it is not bent downwardly along the front end wall 34*a*, but it extends backwardly and then is folded toward the upper folding portion 92*a*. That is, the front end portion of the loosening portion 92 is kept under a so-called slacking state. In general, as shown in FIGS. 28A to 28C, when the upper heat seal 87 is pulled out, the worker's pulling force is liable to be greatest at the initial stage of the pull-out. Accordingly, when the loosening member 91 is configured so that the front end of the loosening portion 92 loosens developer without slacking, the force and load which are required for the worker to pull out the upper heat seal 87 may be extremely large at the initial stage of the pull-out. In the exemplary embodiment, the front end of the loosening portion 92 is kept under a slacking state, and thus the force of loosening developer hardly acts just after the pull-out is started. Accordingly, the force required to start exfoliation of the upper heat seal 87 is not superposed on the force acting when the loosening member 91 loosens developer, so that the pull-out force is prevented from being excessively increased, that is, the force required for the operation is reduced. The loosening member 91 may be designed to be longer and disposed along the front end wall 34*a* under a slacking state. In this case, however, the overall length of the loosening member 91 is long, and also the strip-shaped loosening portion 92 like a string may easily entwine.

In the exemplary embodiment, the loosening portion 92 is not downwardly bent from the drop seal 79 till the upper folding position 92*a* at which the loosening portion 92 is downwardly bent, and the loosening portion 92 does not pass through the area which is at the front side of the upper folding portion 92*a* and at the lower side of the loosening drawing port 78 in the starter accommodating space 73, so that the developer is not loosend. However, in the exemplary embodiment, the upper folding position 92*a* of the loosening portion 92 is set to the front side of the upper inlet port 74, and also the loosening drawing port 78 is disposed at the lower side of the upper inlet port 74, so that non-loosend developer flows into the second stirring chamber 48. Accordingly, the non-loosend developer is prevented from being supplied to the developing roll mount chamber 46, and the developer can be suppressed from being used for development under the state that it is not sufficiently stirred and flaked.

In the exemplary embodiment, when the loosening portion 92 is drawn out, it is drawn out to the front side while passing through the drop seal 79. The loosening portion 92 is disposed in the starter accommodating space 73 filled with developer, and the developer adheres to the surface of the loosening portion 92. However, when the loosening portion 92 passes through the drop seal 79, the cleaner portion 82*b* which comes into contact with the surface of the loosening portion 92 wipes and cleans the loosening portion 92. Accordingly, as compared with a case where the loosening portion 92 is not cleaned, the developer adhering to the drawn loosend portion 91 is suppressed from staining worker's hands or clothes, the copying machine U, etc. Furthermore, in the exemplary embodiment, with respect to the heat seals 87 and 88, developer is accommodated at only the starter accommodating space 73 side, and no developer is accommodated at the developer container 36 side, so that the heat seals 87 and 88 are not stained. When the heat seals 87, 88 are drawn out, they are drawn out while the surfaces of the heat seals to which developer adheres are wiped by the developing housing seal 37 of the developer container 36 side. Accordingly, in the exemplary embodiment, the heat seals 87 and 88 are also drawn out while the surfaces thereof are cleaned, and thus the heat seals 87 and 88 which are drawn out are suppressed from pollution the outside of the machine.

In the exemplary embodiment, a cleaner portion 82*b* formed of cloth is used as a portion of the drop seal 79 which comes into contact with the loosening portion 92. Accordingly, as compared with a case where polyurethane or the like is used, the cleaning performance is enhanced and thus developer can be more surely wiped. Furthermore, in the exemplary embodiment, the cleaner portion 82*b* is pressed against the loosening portion 92 by the elastic force of the polyurethane cushion portion 82*a*, and the loosening portion 92 is more surely cleaned as a case where the cleaner portion 82*b* is not pressed. It may be possible that the cushion portion 82*a* is not provided and only the cleaner portion 82*b* formed of cloth is provided. However, when only the cleaner portion 82*b* formed of cloth is provided, the precision of the thickness is not enhanced and it is more difficult to set the contact pressure between the loosening portion 92 and the cleaner portion 82*b* to a preset pressure as compared with the case where polyurethane or the like is used. Therefore, the cushion portion 82*a* is provided in this exemplary embodiment. Furthermore, when only the cleaner portion 82*b* of cloth is provided, the loosening portion 92 comes into contact with the inner surface of the developing housing 36 and the seal board 81 without cushion of the cushion portion 82*a*, and thus the loosening portion 92 may be cut out at some midpoint thereof.

Furthermore, in the exemplary embodiment, the resin film 96 is adhesively attached to the double-sided tape 94 for supporting the rear end of the loosening portion 92 so that the double-sided tape 94 is not drawn out together with the loosening portion 92. If the double-sided tape 94 is exfoliated from the rear end wall 34*b* together with the loosening portion 92, the double-sided tape 94 cannot pass through the drop seal 79 when the loosening portion 92 passes through the drop seal 79. Therefore, there is a risk that the loosening member 91 cannot be drawn out or the double-sided tape 94 falls off from the loosening member 91 when the loosening member 91 passes through the drop seal 79 and drops into the second stirring chamber 48, so that the double-sided tape 94 is carried as foreign material in the developing housing and causes developing failure. Accordingly, in the exemplary embodiment, the double-sided tape 94 is configured so as to easily remain on the rear end wall 34*b*, and the double-sided tape 94 is more greatly suppressed from exercising an adverse effect as foreign material, as compared with the case where the double-sided tape 94 is easily exfoliated from the rear end wall 34*b*.

A new process cartridge UY to UK which is set to a usable state because the heat seals 87, 88 are detached is mounted in the image forming apparatus main body U2. In FIGS. 19A to 19C, when the process cartridge UY to UK is inserted from the front side, the backlash regulating projection 36*b* of the process cartridge UY to UK is fitted to the backlash regulating guide 11 of the unit supporting portion 2 to regulate the backlash before the color identification key RC1 of the process cartridge UY to UK is engaged with the identification path 9*y* to 9*k* of the unit supporting portion 2. Accordingly, when the color identification key RC1 is engaged with the identification path 9*y* to 9*k*, the color identification key RC1 is engaged with the identification path 9*y* to 9*k* under the state that the backlash of the process cartridge UY to UK is reduced.

In a case where a worker is about to erroneously mount a process cartridge UY to UK whose color is different from the original color under the state that the backlash is not reduced, even when the color identification key RC1 thereof is not engaged with the identification path 9*y* to 9*k* and thus collides against the color identification guide 8*y*, 8*m*, 8*c*, 8*k*, the color identification key RC1 may be erroneously mounted in the identification path 9*y* to 9*k* in spite of the different color by moving the process cartridge UY to UK in the up-and-down or right-and-left direction or in the rotational direction within the backlash range.

On the other hand, according to the exemplary embodiment, the backlash is reduced before the color identification key RC1 is engaged with the identification path 9*y* to 9*k*, and thus the erroneous mounting of the color identification key RC1 can be suppressed as compared with the conventional construction that backlash is not regulated. Particularly, in the exemplary embodiment, the backlash regulating projection 36*b* and the backlash regulating guide 11 are disposed at the front side corresponding to the worker's operation side for the process cartridges UY to UK, and thus the backlash can be regulated at the side nearer to the worker as compared with the case where they are disposed at the rear side.

In the configuration of the exemplary embodiment, the gap between the process units UY to UK is narrow, the overall configuration of the image forming apparatus U is miniaturized, and the space in which the color identification key RC1 and the identification path 9*y* to 9*k* are arranged is designed to be small. Accordingly, the positional difference of the color identification keys RC1 and also the positional difference of the identification path 9*y* to 9*k* must be set to be small with respect to Y, M, C, K, and thus erroneous mounting is liable to occur particularly when there is backlash. Accordingly, in the configuration that it is hard to secure the space for arranging the color identification keys RC1 as in the exemplary embodiment, it is more strongly required to reduce the erroneous mounting by regulating the backlash with the backlash regulating guide 11 and the backlash regulating projection 36*b* as compared with a case where a sufficient space for arranging the color identification key RC1 and the identification path 9*y* to 9*k* can be secured.

Figure 31A:
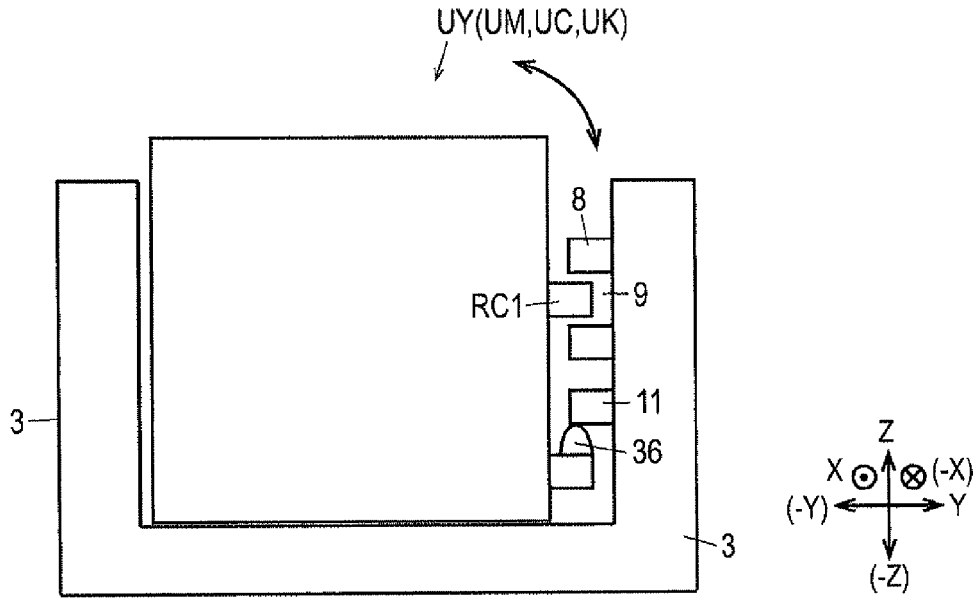
Figure 31B:
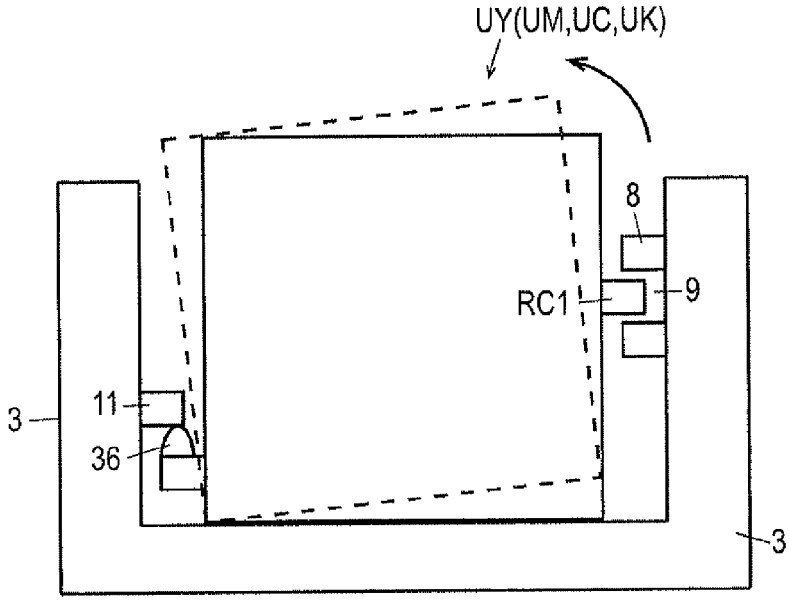

FIGS. 31A and 31B are diagrams showing the relationship between the identification target portion and the regulation target portion of the process unit and the identifying unit and the regulating unit of the unit mounting unit, wherein FIG. 31A is a diagram showing the configuration of the exemplary embodiment, and FIG. 31B shows a state when the regulation target portion and the regulating unit are disposed in the opposite arrangement style to the exemplary embodiment.

Furthermore, in a case where the backlash regulating projection 36*b* and the color identification key RC1 are arranged at the opposite side portions as shown in FIG. 31B, it is assumed that the color identification key RC of the process cartridge UY to UK of an erroneous color interferes with the color identification guide 8*y* to 8*k*. In this case, when the process cartridge UY to UK is rotated, the process cartridge UY to UK is rotated around the contact portion between the backlash regulating projection 36 and the backlash regulating guide 11 as shown in FIG. 31B. Accordingly, with respect to a color identification key RC1 which is farther away from the rotational center, that is, which has a larger turning radius, the moving amount thereof is liable to be larger, and it may be erroneously mounted in a different color identification path 9*y* to 9*k*.

On the other hand, as shown in FIG. 31A, in the exemplary embodiment, the backlash regulating projection 36*b*, the backlash regulating guide 11, the color identification key RC1 and the identification path 9*y* to 9*k* are arranged at the right-handed side portion when viewed from the upstream side with respect to the mounting direction of the process cartridge UY to UK. Accordingly, the distance of the color identification key RC1 from the contact portion between the backlash regulating projection 36 and the backlash regulating guide 11 is short, and thus the turning radius of the color identification key RC1 is small. Accordingly, even when the process cartridge UY to UK is rotated, the moving amount of the color identification key RC1 is small, and the amount of movement until the left side surface of the process cartridge comes into contact with the erected wall 3 of the cartridge supporting portion 2 is small. Therefore, the erroneous mount risk can be reduced.

Furthermore, as shown in FIGS. 31A and 31B, in the configuration of the exemplary embodiment in which the backlash regulating projection 36*b*, the backlash regulating guide 11, the color identification key RC1 and the identification path 9*y* to 9*k* are arranged at the same side, the length of the configuration in the right-and-left direction is shortened, and the configuration can be expected to be more compact as a whole.

Furthermore, according to the exemplary embodiment, as shown in FIG. 19C, under the state that the mount of the process cartridges UY to UK is completed, the engagement between the backlash regulating projection 36*b* and the backlash regulating guide 11 is released and the regulation of the backlash of the process cartridges UY to UK is released. When the engagement between the backlash regulating projection 36*b* and the backlash regulating guide 11 is not released, it is necessary to position the process cartridges UY to UK by the backlash regulating projection 36*b* and the backlash regulating guide 11, precision is required and also the positional relationship of the coupling 26, the gear G1, etc. and the driving system is required to be matched among these parts. However, in the exemplary embodiment, when the mount of the process cartridges UY to UK is completed, the engagement between the backlash regulating projection 36*b* and the backlash regulating guide 11 is released, and the process cartridges UY to UK can be positioned by the couplings 26 or the like.

Furthermore, according to the exemplary embodiment, the backlash regulating guides 11*y*, 11*m* of Y and M are provided with the interference ribs 12*y* and 12*m*, respectively. Accordingly, when a process cartridge of C color or K color in which the color identification key RC1 is provided at the upper side of the backlash regulating guide 11 is erroneously inserted into the mount portion of Y color or M color for which the color identification key RC1 is provided at the lower side of the backlash regulating guide 11, the interference ribs 12*y*, 12*m* interfere with the color identification key RC1 of C color or K color at the initial stage when the insertion is started. Accordingly, the worker can recognize at an early stage that the wrong color process cartridge is inserted.

(Modifications)

The present invention is not limited to the above-described exemplary embodiment, and various modifications may be made to the exemplary embodiment without departing from the subject matter of the present invention. Exemplary embodiment Modifications (H01) to (H015) of the present invention will be described below.

(H01) In the above-described exemplary embodiment, the copying machine is described as an example of the image forming apparatus. However, the present invention is not limited to the copying machine, and the image forming apparatus of this invention may be configured by a printer, FAX, a multifunction machine having plural or all the functions of these machines, or the like.

(H02) In the above-described exemplary embodiment, the copying machine U is configured so that developer of four colors is used. However, the present invention is not limited to this configuration. For example, the present invention may be applied to a monochromatic image forming apparatus, a multi-color image forming apparatus of five colors or more, or three colors or less.

(H03) In the above-described exemplary embodiment, the height, shape and number of the partition ribs 77 are not limited to those of the exemplary embodiment described above, and they may be arbitrarily changed. The positional relationship of the height of the partition ribs 77 and the upper inlet port 74 or the loosening drawing port 78 is not limited to that of the above-described exemplary embodiment, and any positional relationship different from the positional relationship of the above-described exemplary embodiment may be adopted. Furthermore, the partition ribs 77 may be omitted.

(H04) In the above-described exemplary embodiment, the loosening portion 92 is disposed along the partition ribs 77. However, the overall loosening portion 92 is not necessarily required to be disposed along the partition rib 77, but the loosening portion 92 may be disposed partially along the partition rib 77 or it may be disposed so as to extend till some midpoint of the partition rib 77 without extending to the bottom portion of the partition rib 77.

(H05) In the above-described exemplary embodiment, the loosening member 91 is drawn out integrally with the upper heat seal 87, however, the present invention is not limited to this configuration. For example, the loosening member 91 may be configured so as to be drawn out integrally with the lower heat seal 88 or so as to be independently drawn out. When the upper heat seal 87 and the lower heat seal 88 are arranged to be drawn out integrally with each other, the loosening member 91 can be drawn out integrally with the upper and lower heat seals 87 and 88.

(H06) In the above-described exemplary embodiment, the end of the loosening portion 92 at the loosening drawing port 78 side is set under the slacking state, however, the present invention is not limited to this configuration. For example, the end of the loosening portion 92 may be configured so as to disposed along the front end wall 34*a* without slacking, so as to be obliquely folded without being downwardly folded or so as to horizontally extend till the up-front partition rib 77.

(H07) In the above-described exemplary embodiment, the configuration of the drop seal 79 is not limited to the configuration of the exemplary embodiment, and any configuration may be adopted by omitting the seal board 81, omitting any one of the cushion portion 82*a* and the cleaner portion 82*b* or using different materials therefor.

(H08) In the above-described exemplary embodiment, the first stirring chamber 47 and the second stirring chamber 48 are obliquely arranged in the developing devices Gy to Gk. However, the present invention is not limited to this configuration, but may be applied to a developing device in which the first stirring chamber 47 and the second stirring chamber 48 are arranged in parallel with each other in the horizontal direction or in the gravitational force direction. Furthermore, the configuration of the auger is not limited to that of the exemplary embodiment, and any well-known configuration may be adopted.

(H09) In the above-described exemplary embodiment, the specific configurations, materials, terminal numbers, positions, etc. of CRUM 41 and the CRUM adaptor 42 may be freely changed in accordance with design, specification or the like.

(H010) In the above-described exemplary embodiment, the connection terminal 44 of the density sensor SN is not provided with the member corresponding to the CRUM adaptor 42, however, the member corresponding to the CRUM adaptor 42 may be provided.

(H011) In the above-described exemplary embodiment, the color identification is performed by the color identification key RC1 and the identification path 9*y* to 9*k*, however, the present invention is not limited to this configuration. For example, the present invention may be applied to an identifying unit for identifying so-called OEM (Original Equipment Manufacturing) sides or identifying selling areas of Asia, North America, European, etc., so-called destinations. That is, the present invention is not limited to the configuration that plural identifying units are provided to one image forming apparatus, and the present invention may be applied to a configuration that a process cartridge which can be detachably mounted in plural types of image forming apparatuses is identified.

(H012) In the above-described exemplary embodiment, the process cartridge UY to UK having the photoconductor PRy to PRk and the developing device Gy to Gk is described as an example of a detachable mount body. However, the present invention is not limited to the process cartridge UY to UK, and may be applied to any detachable body which is detachably mounted in the image forming apparatus main body U2, such as a developer cartridge Ky to Kk, a photoconductor unit and a developing unit which are configured so that the photoconductor PRy to PRk and the developing device Gy to Gk are configured as separate units, a collecting container for collecting wasted developer, a fixing unit or the like.

(H013) In the above-described exemplary embodiment, the backlash regulating projection 36*b*, the backlash regulating guide 11, the color identification key RC1 and the identification path 9*y* to 9*k* are arranged at the right side of the process cartridge UY to UK as shown in FIG. 31A. However, the present invention is not limited to this configuration. For example, the arrangement shown in FIG. 31B may be adopted, or the backlash regulating projection 36*b*, etc. may be arranged at the right and left sides.

(H014) In the above-described exemplary embodiment, the interference ribs 12*y* and 12*m* are provided. However, they may be omitted. Furthermore, the interference ribs are provided for only Y color and M color. However, the interference ribs may be provided at the lower side for C color and K color. Still furthermore, the position and shape of the interference rib may be arbitrarily changed in accordance with design, specification or the like.

(H015) In the above-described exemplary embodiment, the backlash regulating projection 36*b*, the backlash regulating guide 11, the color identification key RC1 and the identification path 9*y* to 9*k* are configured as a combination of projecting portions formed at the process unit side (UY to UK) and recessed portions formed at the unit supporting unit side. However, the present invention is not limited to this configuration, and the relationship between the projecting portion and the recessed portion may be inversed to each other.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the principle of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a developer holding member being disposed so as to face an image carrier having a surface on which a latent image is formed and rotating while holding developer on the surface thereof;

a developing housing that has a holding member mount unit in which the developer holding member is mounted, and accommodates developer therein;

a developer container that is connected to the developing housing through an inlet port and contains developer that flows into the developing housing;

a partition member that is disposed in the developer container and partitions an inner space of the developer container; and a loosening member having a loosening portion that is disposed in the developer container so as to extend upwardly along one side surface, cross over an upper end of the partition member, folds back downwardly and extends along the other side surface of the partition member for partitioning the inner space of the developer container, and a drawing portion that is connected to the loosening portion and extends from a loosening drawing port formed in the developer container to the outside of the developer container, wherein, when the drawing portion is drawn out, the loosening portion moves to loosen the developer in the developer container.

2. The developing device according to claim 1, wherein the developing housing has a first stirring chamber disposed at the lower side of the holding member mount unit so as to be adjacent to the holding member mount unit, and a second stirring chamber that is disposed at a side of the first stirring chamber so as to be adjacent to the first stirring chamber, in which a developing roll, the first stirring chamber, and the second stirring chamber are aligned in the stated order, the inlet port has a first inlet port through which the developer container is connected to the holding member mount unit, and a second inlet port through which the developer container is connected the second stirring chamber, and the loosening portion is disposed along the side surface of the partition member from an upper end portion of the developer container to the position corresponding to the second inlet port.

3. The developing device according to claim 2, wherein the first inlet port is located at a position lower than the upper end of the partition member.

4. The developing device according to claim 1, wherein the upper end of the partition member is located at a higher position than the loosening drawing port formed in a side wall of the developer container, and the loosening portion is disposed along one side surface and the other side surface of the partition member from the bottom portion of the developer container to the upper end of the partition member.

5. The developing device according to claim 4, wherein the developing housing has a first stirring chamber disposed at the lower side of the holding member mount unit so as to be adjacent to the holding member mount unit, and a second stirring chamber that is disposed at a side of the first stirring chamber so as to be adjacent to the first stirring chamber, in which a developing roll, the first stirring chamber, and the second stirring chamber are aligned in the stated order, the inlet port has a first inlet port through which the developer container is connected to the holding member mount unit, and a second inlet port through which the developer container is connected the second stirring chamber, and the loosening portion is disposed along the side surface of the partition member from an upper end portion of the developer container to the position corresponding to the second inlet port.

6. The developing device according to claim 5, wherein the first inlet port is located at a position lower than the upper end of the partition member.

7. The developing device according to 1, further comprising a sealing member that closes the inlet port in a state where developer is contained in the developer container and is removably supported on the developing housing, wherein the sealing member is connected to the drawing portion of the loosening member, and drawn out to be removed from the developing housing when the drawing portion is drawn out.

8. The developing device according to claim 7, wherein in the developer container, an end portion of the loosening portion at the loosening drawing port side extends from the loosening drawing port to the partition member side and also extends to the bottom portion side of the developer container between the loosening drawing port and the partition member.

9. The developing device according to claim 8, wherein one end of the inlet port is disposed at the partition member side with respect to a position at which the loosening member extends from the partition member side to the bottom portion side.

10. The developing device according to 1, further comprising a contact member that is disposed at the loosening drawing port and brought into contact with the drawing portion and the loosening portion under preset contact pressure to clean the drawing portion and the loosening portion when the loosening member is drawn out, the contact member hermetically sealing the loosening drawing port in a state where the loosening member is drawn out.

11. The developing device according to claim 10, wherein the contact member comprises a cleaning unit that is formed of cloth and brought into contact with the loosening member, and a pressure applying unit formed of elastic material that supports the cleaning unit and generates the contact pressure.

12. The developing device according to claim 1, wherein the loosening portion moves in a direction intersecting the one side surface and the other side surface of the partition member to loosen the developer in the developer container.

13. An image forming apparatus comprising:

a rotating image carrier;

a latent image forming device that forms a latent image on the surface of the image carrier;

a developing device according to claim 1, which develops the latent image on the surface of the image carrier into a visible image;

a transfer device that transfers the visible image on the surface of the image carrier to a medium, the visible image having been developed with the developer by the developing device based on the latent image; and a fixing device that fixes the visible image on the surface of the medium.

14. An image forming apparatus comprising:

a rotating image carrier;

a latent image forming device that forms a latent image on the surface of the image carrier;

a developing device according to claim 2, which develops the latent image on the surface of the image carrier into a visible image;

a transfer device that transfers the visible image on the surface of the image carrier to a medium, the visible image having been developed with the developer by the developing device based on the latent image; and a fixing device that fixes the visible image on the surface of the medium.

15. An image forming apparatus comprising:

a rotating image carrier;

a latent image forming device that forms a latent image on the surface of the image carrier;

a developing device according to claim 4, which develops the latent image on the surface of the image carrier into a visible image;

a transfer device that transfers the visible image on the surface of the image carrier to a medium, the visible image having been developed with the developer by the developing device based on the latent image; and a fixing device that fixes the visible image on the surface of the medium.

16. An image forming apparatus comprising:

a rotating image carrier;

a latent image forming device that forms a latent image on the surface of the image carrier;

a developing device according to claim 5, which develops the latent image on the surface of the image carrier into a visible image;

a transfer device that transfers the visible image on the surface of the image carrier to a medium, the visible image having been developed with the developer by the developing device based on the latent image; and a fixing device that fixes the visible image on the surface of the medium.

17. An image forming apparatus comprising:

a rotating image carrier;

a latent image forming device that forms a latent image on the surface of the image carrier;

a developing device according to claim 7, which develops the latent image on the surface of the image carrier into a visible image;

a transfer device that transfers the visible image on the surface of the image carrier to a medium, the visible image having been developed with the developer by the developing device based on the latent image; and a fixing device that fixes the visible image on the surface of the medium.

18. An image forming apparatus comprising:

a rotating image carrier;

a latent image forming device that forms a latent image on the surface of the image carrier;

a developing device according to claim 8, which develops the latent image on the surface of the image carrier into a visible image;

a transfer device that transfers the visible image on the surface of the image carrier to a medium, the visible image having been developed with the developer by the developing device based on the latent image; and a fixing device that fixes the visible image on the surface of the medium.

19. An image forming apparatus comprising:

a rotating image carrier;

a latent image forming device that forms a latent image on the surface of the image carrier;

a developing device according to claim 9, which develops the latent image on the surface of the image carrier into a visible image;

a transfer device that transfers the visible image on the surface of the image carrier to a medium, the visible image having been developed with the developer by the developing device based on the latent image; and a fixing device that fixes the visible image on the surface of the medium.

* * * * *